US007915559B2

(12) United States Patent
Goto et al.

(10) Patent No.: US 7,915,559 B2
(45) Date of Patent: Mar. 29, 2011

(54) ELECTRODE FOR ELECTRIC DISCHARGE SURFACE TREATMENT, METHOD FOR MANUFACTURING ELECTRODE, AND METHOD FOR STORING ELECTRODE

(75) Inventors: Akihiro Goto, Tokyo (JP); Masao Akiyoshi, Tokyo (JP); Katsuhiro Matsuo, Nagoya (JP); Hiroyuki Ochiai, Tokyo (JP); Mitsutoshi Watanabe, Tokyo (JP); Takashi Furukawa, Tokyo (JP)

(73) Assignees: Mitsubishi Denki Kabushiki Kaisha, Tokyo (JP); Ishikawajima-Harma Heavy Industries Co., Ltd., Tokyo (JP)

( * ) Notice: Subject to any disclaimer, the term of this patent is extended or adjusted under 35 U.S.C. 154(b) by 1330 days.

(21) Appl. No.: 11/291,878

(22) Filed: Dec. 2, 2005

(65) Prior Publication Data

US 2006/0081462 A1 Apr. 20, 2006

Related U.S. Application Data

(63) Continuation-in-part of application No. PCT/JP2004/001471, filed on Feb. 12, 2004.

(30) Foreign Application Priority Data

Jun. 4, 2003 (JP) ..... 2003-158897
Jun. 5, 2003 (JP) ..... 2003-160507
Jun. 11, 2003 (JP) ..... 2003-166012

(51) Int. Cl.
*B23K 1/04* (2006.01)

(52) U.S. Cl. ..... 219/69.15; 219/69.11; 219/69.17; 427/580

(58) Field of Classification Search ..... 219/69.11, 219/69.15, 69.17; 204/164, 280
See application file for complete search history.

(56) References Cited

U.S. PATENT DOCUMENTS 4,954,169 A 9/1990 Behrens
6,441,333 B1 8/2002 Goto et al.
6,793,982 B1 9/2004 Yamada et al.
6,935,917 B1 8/2005 Goto et al.
2001/0013508 A1 8/2001 Goto et al.

(Continued)

FOREIGN PATENT DOCUMENTS

CN 1286733 A 3/2001

(Continued)

OTHER PUBLICATIONS

Korean Office Action dated Nov. 14, 2006 issued in KR Application No. 10-2005-7023285.

(Continued)

*Primary Examiner* — Mark H Paschall
*Assistant Examiner* — Brian Jennison
(74) *Attorney, Agent, or Firm* — Sughrue Mion, PLLC

(57) ABSTRACT

An electrode for electric discharge surface treatment, in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work, is a molded powder that is formed by molding a material powder including a metallic powder, a metallic compound powder, and a conductive ceramic powder. A powder solid that is formed as a result of coagulation of the material powder, and that is included in the molded powder has a diameter shorter than a distance between the electrode and the work.

18 Claims, 17 Drawing Sheets

U.S. PATENT DOCUMENTS

| | | | | |
|---|---|---|---|---|
| 2001/0014405 | A1 | 8/2001 | Yuzawa et al. | |
| 2006/0021868 | A1 * | 2/2006 | Goto et al. | 204/164 |

FOREIGN PATENT DOCUMENTS

| | | | |
|---|---|---|---|
| CN | 693872 | A5 | 3/2004 |
| CN | 694120 | A5 | 7/2004 |
| DE | 19701170 | A1 | 7/1997 |
| JP | 5-148615 | A | 6/1993 |
| JP | 05-148615 | A | 6/1993 |
| JP | 07-197275 | A | 8/1995 |
| JP | 7-197275 | A | 8/1995 |
| JP | 8-300227 | A | 11/1996 |
| JP | 11-229159 | A | 8/1998 |
| JP | 2000-096105 | A | 4/2000 |
| JP | 3227454 | B2 | 8/2001 |
| KR | 950007174 | B | 7/1995 |
| KR | 97-001559 | B | 2/1997 |
| RU | 2023316 | C1 | 11/1994 |
| SU | 1479208 | A1 | 5/1989 |
| WO | 99-58744 | A1 | 11/1999 |
| WO | WO 99/58744 | A1 | 11/1999 |
| WO | 01-05545 | A1 | 1/2001 |
| WO | WO 01/05545 | A1 | 1/2001 |
| WO | 0123641 | A | 4/2001 |
| WO | 0124961 | A | 4/2001 |
| WO | WO 01/23640 | A | 4/2001 |

OTHER PUBLICATIONS

Formation of hard layer on metallic Material by EDM Akihiro Goto et al. Proc. International Symposium for Electro-machining (ISEM 12).

Development of Electrical Discharge Coating Method Akihiro Goto et al. Proc. International Symposium for Electro-machining (ISEM 13).

S. S. Kiparisov, et al., Powder Metallurgy, 1980, p. 25, Metallurgiya Publishers, Moscow.

European Office Action corresponding to European Patent Application 04710516.8, dated Aug. 24, 2010.

* cited by examiner

ELECTRODE FOR ELECTRIC DISCHARGE SURFACE TREATMENT, METHOD FOR MANUFACTURING ELECTRODE, AND METHOD FOR STORING ELECTRODE

CROSS REFERENCE TO RELATED APPLICATIONS

This is a Continuation-in-Part of PCT/JP2004/001471 filed on Feb. 12, 2004 and which claims priority from Japanese Patent Application Nos. 2003-158897 filed on Jun. 4, 2003, 2003-160507 filed on Jun. 5, 2003 and 2003-166012 filed on Jun. 11, 2003 the above-noted applications incorporated herein by reference in their entirety.

BACKGROUND OF THE INVENTION

1) Field of the Invention

The present invention relates to a technology for electric discharge surface treatment, more particularly to an electrode for electric discharge surface treatment.

2) Description of the Related Art

For a turbine blade of a gas turbine engine for aircrafts, it is necessary to process a surface of the turbine blade by coating or hardfacing with a material that has strength and lubrication property in high-temperature environments. Chromium (Cr) and molybdenum (Mo) become lubricant if Cr and Mo are oxidized in a high-temperature environment. Therefore, a cobalt (Co) base material that includes Cr or Mo is used to form a thick coat through a scheme, such as welding or thermal spraying.

In the welding, a material of the welding rod is fused to deposit on a work by causing electric discharge between the work and the welding rod. In the thermal spraying, a metallic material is melted, and a coat of the metallic material is formed on a surface of a work by spraying the metallic material melted on the surface.

However, both the welding and the thermal spraying are manual operations and require a skill. Therefore, it is difficult to perform such operations on a production line, disadvantageously leading to an increase in a manufacturing cost. Moreover, since the welding in particular is a scheme in which heat intensively enters a work, if a material to be processed is thin or easily broken, weld cracking is likely to occur, thereby disadvantageously reducing yield. A material that is easily broken is, for example, a single-crystal alloy or a directionally-controlled alloy, such as a unidirectionally-solidified alloy, is processed.

As another technology for surface treatment, a surface treatment by electric discharge machining (hereinafter, "electric discharge surface treatment") has also been established. Such a technology is disclosed, for example, in International Publication No. 99/58744 Pamphlet.

In forming a thick coat by the electric discharge surface treatment, the most important factors that influence coating performance are supply of a material from an electrode, and a condition of melting and bonding with a work material of the material supplied on a work surface. The strength, that is, hardness, of the electrode has an influence on the supply of the electrode material. In a method disclosed in International Publication No. 99/58744 Pamphlet, with an electrode for electric discharge surface treatment that is hard to some extent, supply of an electrode material by electric discharge is suppressed, and the electrode material is sufficiently melted to form a hard ceramic coat on a work surface. However, the coat is limited to a thin coat of up to approximately 10 micrometers (μm).

Therefore, it is impossible to form a dense thick coat (as thick as 100 μm or more) to be used for purposes requiring strength and lubrication property in the high-temperature environments as described above.

In a conventional electric discharge surface treatment, a green compact formed by compression molding a ceramic powder is used to form a coat of a hard material, such as titanium carbide (TiC), to improve abrasion resistance of a component and a mold. An electrode that is used in such electric discharge surface treatment is manufactured by compression molding a ceramic powder with a press and then by heating. Such a technology is disclosed in, for example, Japanese Patent No. 3227454.

In recent years, demands for forming a metallic coat that has a lubrication property and corrosion resistance by electric discharge surface treatment are increasing. It has become apparent by experiments conduced by the inventors that, to form a metallic coat having a lubrication property and corrosion resistance by electric discharge surface treatment, a metallic powder of which an average grain diameter is 3 μm or less is required to be used to manufacture an electrode.

However, grains in such metallic powder tend to coagulate into large solids due to a strong force occurring between the grains by an action of an intermolecular force or an electrostatic force. If an electrode of a green compact that is formed with the metallic power including such large solids is used in the electric discharge surface treatment, the large solids are deposited on the work surface, thereby disadvantageously causing not only a short circuit and instability in electric discharge but also deterioration in surface roughness of the coat.

In a technology disclosed in the invention of Japanese Patent No. 3227454, a ceramic powder, in which a force between grains thereof is weak, is used. Therefore, the grains are less likely to coagulate into large solids even after mixing paraffin. Thus, in the invention of Japanese Patent No. 3227454, no measure is taken for addressing such coagulation.

Moreover, conventionally, in manufacturing a metallic electrode, another technology for manufacturing an electrode that is not formed with the green compact has been established. In the technology, the electrode is formed by molding a metallic powder is molded by a press, and then by heating until metal of the metallic powder is completely melted. Also in this case, since the metal is melted, no measure is taken for addressing the coagulation of grains of the metallic powder.

Furthermore, in a conventional method for manufacturing an electrode, an electrode is manufactured by compression molding a commercially-available ceramic powder with a press in an atmosphere, and then by heating (for example, the method disclosed in Japanese Patent No. 3227454). Ceramics used for the electrode has a high oxidation temperature. Therefore, even if a dried powder of ceramics having an average grain diameter of the order of 1 μm is left in an atmosphere, ceramics is not oxidized. Thus, it is easy to prepare a material because a ceramic powder having an average grain diameter of several μm is commercially available. In addition, molding is easily performed.

Furthermore, another method for electric discharge surface treatment is disclosed in Japanese Patent Laid-Open Publication No. H5-148615. In the method, a thick coat of which thickness is several tens of millimeters (mm) is formed with tungsten carbide (WC) and Co each having an average grain diameter of the order of 1 μm. WC and Co are also metal less likely to be oxidized as well as TiC. Such metal less likely to be oxidized includes nickel (Ni). Such technology for forming a coat of hard ceramics on a work surface by an electrode formed with ceramics and WC has been achieved by conventional technologies.

As described above, in recent years, there have been increasing demands for a metallic coat having a lubrication property and corrosion resistance in high-temperature environments that are formed by the electric discharge surface treatment. Moreover, for maintenance and dimensional correction of metallic components, application of a thick coat formed with metal or an alloy by the electric discharge surface treatment has been demanded. As described above, it has become apparent that, to form a coat of metal or an alloy by the electric discharge surface treatment, an electrode is required to be manufactured with a powder having an average grain diameter of 3 μm or less.

However, a metallic powder or an alloy powder having a grain diameter of 3 μm or less that are available on the market are limited to powders of material less likely to be oxidized. In other words, it is difficult to obtain powders of various materials for forming an electrode for electric discharge surface treatment.

For example, titanium (Ti), which is light in weight, high in strength, and less likely to be oxidized at high temperatures, is used for a compressor of a jet engine. A solid of Ti is hardly oxidized except for a portion of a surface being slightly oxidized in an atmosphere, while a portion inside remains as Ti. However, in Ti in a form of powder of which the grain diameter of several μm, an influence of a surface area with respect to volume is increased. Thus, heat generated due to oxidation on a surface of grains of the powder propagates into a portion inside the grains, thereby causing oxidization also in the portion inside of the grains. When oxidized, conductivity, which is a property that the Ti powder originally has, is lost. Therefore, such a powder cannot be used for an electrode for the electric discharge surface treatment. This is because if the electrode does not have conductivity, it is impossible to discharge electricity. Moreover, oxidation of the Ti powder may explosively proceed. For the above reasons, it is difficult to obtain the powder having an average grain diameter suitable for manufacturing an electrode for the electric discharge surface treatment. Even if such powder is available, it is impossible to manufacture an electrode for electric discharge surface treatment by the conventional methods.

SUMMARY OF THE INVENTION

It is an object of the present invention to solve at least the above problems in the conventional technology.

An electrode for electric discharge surface treatment according to one aspect of the present invention is a molded powder that is formed by molding a material powder that is any one of a metallic powder, a metallic compound powder, and a conductive ceramic powder, and is used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work. A powder solid that is formed as a result of coagulation of the material powder has a diameter shorter than a distance between the electrode and the work, the powder solid being included in the molded powder.

A method according to another aspect of the present invention is for manufacturing an electrode for electric discharge surface treatment according to the above aspect. The electrode material includes a material hard to be carbonized for 40 volume % or more.

An electrode for electric discharge surface treatment according to still another aspect of the present invention is a molded powder that is formed by molding a material power that is any one of a metallic powder and a metallic compound powder, an is used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work The electrode is formed by finely crushing the material powder in a liquid that volatilizes in an atmosphere, and then by molding the material powder crushed in a state in which the material power is not completely dried.

An electrode for electric discharge surface treatment according to still another aspect of the present invention is a molded powder that is formed by molding a material power that is any one of a metallic powder and a metallic compound powder, and is used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work. The electrode is formed by molding the material powder that is finely crushed in a liquid that volatilizes in an atmosphere while drying the material powder, which is crushed, under pressure.

An electrode for electric discharge surface treatment according to still another aspect of the present invention is a molded powder that is formed by molding a material power that is any one of a metallic powder and a metallic compound powder, and is used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work The electrode is formed by molding the material powder that is finely crushed in a liquid, and then dried in an atmosphere of which an amount of oxygen is controlled, the material powder dried in such a manner that only a surface of the material powder is oxidized.

An electrode for electric discharge surface treatment according to still another aspect of the present invention is a molded powder that is formed by molding a material power that is any one of a metallic powder and a metallic compound powder, and is used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work The electrode is formed by molding the material powder that is finely crushed in wax.

An electrode for electric discharge surface treatment according to still another aspect of the present invention is a molded powder that is formed by molding a material powder that includes a metallic powder, a metallic compound powder, and a ceramic powder, and is used for electric discharge surface treatment in which a pulse-like electric discharge is caused between the electrode and a work in a dielectric fluid, and in which a coat of an electrode material or a substance that is generated by a reaction of the electrode material due to an electric discharge energy is formed on a surface of the work. Any one of oil and the dielectric fluid is soaked in an internal space of the molded powder.

An electrode for electric discharge surface treatment according to still another aspect of the present invention is a molded powder that is formed by molding a material powder that includes a metallic powder, a metallic compound powder, and a ceramic powder, and is used for electric discharge surface treatment in which a pulse-like electric discharge is caused between the electrode and a work in a dielectric fluid, and in which a coat of an electrode material or a substance that is generated by a reaction of the electrode material due to an electric discharge energy is formed on a surface of the work. The molded powder is heated, and any one of oil and the dielectric fluid is soaked in an internal space of the molded powder heated.

An electrode for electric discharge surface treatment according to still another aspect of the present invention is a molded powder that is formed by molding a material powder that includes a metallic powder, a metallic compound powder, and a ceramic powder, and is used for electric discharge surface treatment in which a pulse-like electric discharge is caused between the electrode and a work in a dielectric fluid, and in which a coat of an electrode material or a substance that is generated by a reaction of the electrode material due to an electric discharge energy is formed on a surface of the work. The electrode is stored in a package in any one of oil, the dielectric fluid, and a non-oxidative atmosphere that prevents oxidization of the material powder.

A method according to still another aspect of the present invention is for manufacturing an electrode for electric discharge surface treatment according to the above aspects, and includes sorting a powder solid that is formed as a result of coagulation of the material powder; fragmenting the powder solid; and molding the material powder of which the powder solid is sorted or fragmented The powder solid is sorted and fragmented in such a manner that a diameter of the powder solid included in the molded powder is shorter than a distance between the electrode and the work.

A method according to still another aspect of the present invention is for manufacturing an electrode for electric discharge surface treatment according to the above aspect, and includes finely crushing the material powder in a volatile solution; molding the material powder finely crushed in a state in which the material power is not completely dried; and volatilizing the volatile solution that is included in the material powder molded.

A method according to still another aspect of the present invention is for manufacturing an electrode for electric discharge surface treatment according to the above aspect, and includes finely crushing the material powder in a liquid; molding the material powder finely crushed without completely drying the material power; and removing the liquid that is included in the material powder molded.

A method according to still another aspect of the present invention is for manufacturing an electrode for electric discharge surface treatment according to the above aspect, and includes finely crushing the material powder in a liquid; drying the material powder finely crushed; and molding the material powder dried.

A method according to still another aspect of the present invention is for manufacturing an electrode for electric discharge surface treatment according to the above aspect, and includes finely crushing the material powder in a volatile solution; drying, in an inert gas atmosphere, the material powder finely crushed; gradually oxidizing the material powder dried; and molding the material powder gradually oxidized.

A method according to still another aspect of the present invention is for manufacturing an electrode for electric discharge surface treatment according to the above aspect, and includes finely crushing the material powder in wax; and molding the material powder finely crushed.

A method according to still another aspect of the present invention is for manufacturing an electrode for electric discharge surface treatment according to the above aspect, and includes forming the molded powder by molding the material powder; and soaking any one of oil and the dielectric fluid in an internal space of the molded powder.

A method according to still another aspect of the present invention is for manufacturing an electrode for electric discharge surface treatment according to the above aspect, and includes forming the molded powder by molding the material powder; heating the molded powder; and soaking any one of oil and the dielectric fluid in an internal space of the molded powder heated.

A method according to still another aspect of the present invention is for storing an electrode for electric discharge surface treatment according to the above aspect, and includes storing the electrode in any one of oil and the dielectric solution.

A method according to still another aspect of the present invention is for storing an electrode for electric discharge surface treatment according to the above aspect, and includes storing the electrode in a non-oxidative atmosphere that prevents oxidation of the material powder.

The other objects, features, and advantages of the present invention are specifically set forth in or will become apparent from the following detailed description of the invention when read in conjunction with the accompanying drawings.

DETAILED DESCRIPTION

Exemplary embodiments according to the present invention will be explained in detail below with reference to the accompanying drawings. The present invention is not limited to the following description, and may be modified appropriately without departing from a scope of the present invention. Moreover, in the accompanying drawings, a scale of each member may differ for a purpose of easy understanding.

In a first embodiment and a second embodiment described below, an electrode for electric discharge surface treatment with which formation of a dense thick coat by stable electric discharge without deteriorating surface roughness of the coat, and a method for manufacturing such an electrode are described.

Figure 1:
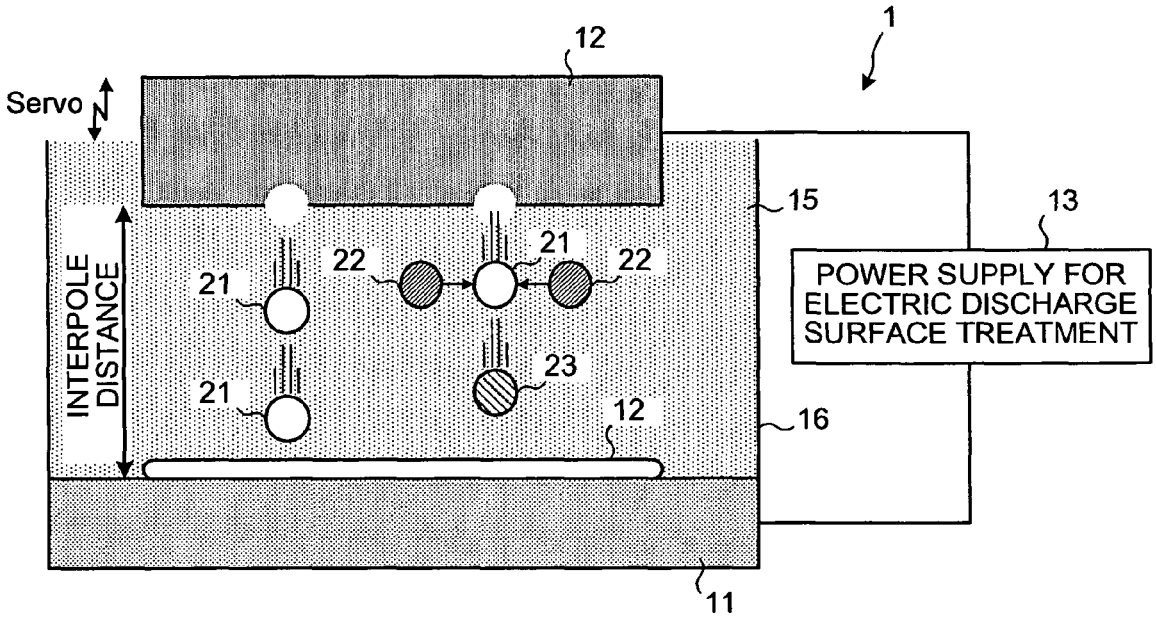
FIG. 1 is a schematic of electric discharge surface treatment in an apparatus for electric discharge surface treatment.

First, an outline of the electric discharge surface treatment and an apparatus therefor used in the present invention is described. The outline described herein is commonly applied throughout the specification. FIG. 1 is a schematic of the electric discharge surface treatment by the apparatus for electric discharge surface treatment. An apparatus for electric discharge surface treatment 1 includes a work piece (hereinafter, "work") 11 on which a coat 14 is desired to be formed, an electrode for electric discharge surface treatment 12 for forming the coat 14 on the surface of the work 11, a power supply for electric discharge surface treatment 13 electrically connected to the work 11 and the electrode for electric discharge surface treatment 12 for supplying a voltage to both of the work 11 and the electrode 12 to cause arc discharge therebetween. When the electric discharge surface treatment is performed in a liquid, a work tank 16 is further provided so that the work 11 and a portion of the electrode for electric discharge surface treatment 12 opposed to the work 11 make contact with an oil-based dielectric fluid 15, such as kerosene. Also, when the electric discharge surface treatment is performed in an atmosphere, the work 11 and the electrode for electric discharge surface treatment 12 are placed in a process atmosphere. In FIG. 1 and the following description, a case in which the electric discharge surface treatment is performed in a dielectric fluid is exemplarily depicted. Furthermore, in the following, the electrode for electric discharge surface treatment may be simply referred to as an electrode. Moreover, in the following, a distance between a surface of the electrode for electric discharge surface treatment 12 and a surface of the work 11 that are opposite to each other is referred to as an interpole distance.

Next, the electric discharge surface treatment by the apparatus for electric discharge surface treatment 1 having the structure as described above is described. The electric discharge surface treatment is performed by, for example, taking the work 11 on which the coat 14 is desired to be formed as a positive pole and the electrode for electric discharge surface treatment 12 as a negative pole using an electrode that is formed of a metal powder or a ceramic powder having an average grain diameter of 10 nanometers (nm) to several tens of μm to be a supply source of the coat 14. While the interpole distance is controlled by a control mechanism, which is not shown, so that these poles do not make contact with each other in the dielectric fluid 15, an electric discharge is caused to take place therebetween.

When an electric discharge occurs between the electrode for electric discharge surface treatment 12 and the work 11, heat due to the electric discharge causes a part of the work 11 and the electrode 12 to be melted. If an intermolecular bond of the electrode 12 is appropriate, a part (hereinafter, "electrode particle") 21 of the electrode 12 melted by a blast or an electrostatic force by the electric discharge is separated from the electrode 12, and is moved toward the surface of the work 11. Then, when reaching the surface of the work 11, the electrode particles 21 are re-coagulated into the coat 14. A part of the separated electrode particles 21 reacts with the dielectric fluid 15 or a component 22 in an atmosphere to form a substance 23, which also contributes to formation of the coat 14. In this manner, the coat 14 is formed on the surface of the work 11.

However, if the bonding between powder particles of the electrode 12 is strong, the electrode 12 is not peeled off by the blast or the electrostatic force by the electric discharge, thereby making it impossible to supply the electrode material to the work 11. That is, whether a thick coat can be formed by the electric discharge surface treatment depends on how the material is supplied from the electrode 12 and how the material supplied is melted on the surface of the work 11 and is bonded with the material of the material of the work 11. How the electrode material is supplied depends on how hard the electrode 12 is, that is, hardness.

Figure 2:
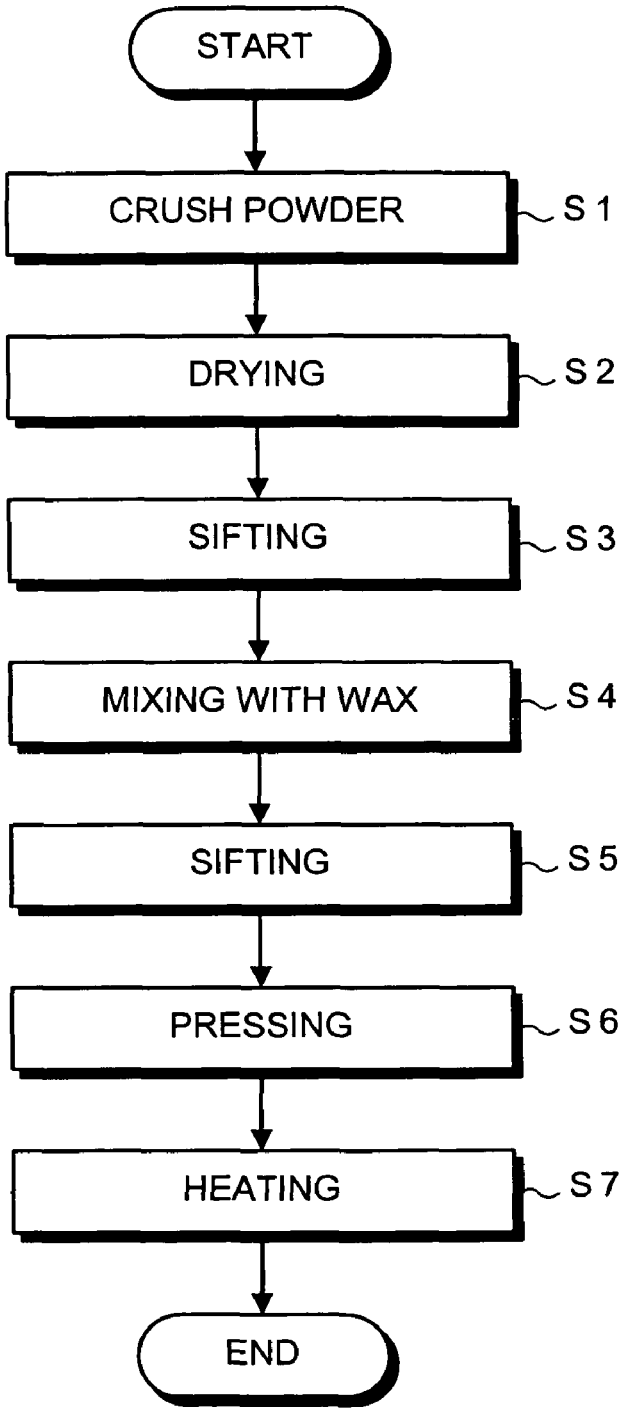
FIG. 2 is a flowchart of a process of manufacturing an electrode for electric discharge surface treatment.

A method for manufacturing the electrode for electric discharge surface treatment 12 fused in the electric discharge surface treatment is described herein. FIG. 2 is a flowchart of a process of manufacturing the electrode for electric discharge surface treatment. First, a metallic powder or a ceramic powder that include a material that forms the coat 14 desired to be formed on the work 11 is crushed (step S1). If the coat 14 is formed with several kinds of materials, powders of the materials are mixed at a desired ratio and crushed. For example, a metallic powder, a metallic alloy powder, or a ceramic spherical powder having an average grain diameter of several tens of μm that is available on the market is crushed by a mill apparatus, such as a ball mill, into grains having an average grain diameter of 3 μm or less. Crushing may be performed in a liquid. In that case, the liquid is evaporated to dry the powder (step S2). Since the powder that is dried includes large solids formed due to coagulation of grains, to fragment the grains in such large solids, and to sufficiently mix the powder with wax at the next step, the powder is sifted (step S3). For example, when a ceramic ball or a metal ball is put on a mesh of a shifter, on which the coagulated grains are left, and vibrated, the grains in the solids formed due to the coagulation are fragmented by a vibration energy and collision of the solids with the ball, and pass through the mesh.

Only grains that pass through the mesh are used in the following steps. Specifically, the powder including coagulated solids is put on a net of which a mesh size is smaller than the interpole distance.

Sifting of the powder crushed at step S3 is described herein. In the electric discharge surface treatment, a voltage applied between the electrode for electric discharge surface treatment 12 and the work 11 for causing an electric discharge is normally within a range of 80 volts (V) to 300 V. When a voltage within this range is applied between the electrode for electric discharge surface treatment 12 and the work 11, the distance between the electrode 12 and the work 11 during the electric discharge surface treatment is of the order of 0.3 mm. As described above, in the electric discharge surface treatment, an arc discharge occurring across both poles causes the coagulated solids forming the electrode 12 to be separated from the electrode without changing a size of the coagulated solids. Here, if the size of the coagulated solids is below the interpole distance (0.3 mm or less), following electric discharge can be generated even if such a solid exists between the poles. Moreover, since the electric discharge occurs at a place in which the poles are close to each other, an electric discharge occurs at a place in which a solid exists, thereby crushing the solid by a thermal energy or explosion of the electric discharge.

However, if the size of the solid forming the electrode 12 is equal to or larger than the interpole distance (0.3 mm or more), an electric discharge causes the solids to be separated from the electrode 12 without changing the size of the solids. Such solids are deposited on the work 11 or are drifted in an interpole space between the electrode 12 and the work 11 filled with the dielectric fluid 15. As in the former case, if large solids are deposited, because an electric discharge occurs at a place in which the electrode 12 and the work 11 are close to each other, the electric discharge is concentrated on that place, and no electric discharge occurs at other places. As a result, the coat 14 cannot be uniformly deposited on the surface of the work 11. In addition, the large solids cannot be completely melted by heat of the electric discharge. Therefore, the coat 14 becomes so brittle that the coat 14 is easily scraped off by hand. Furthermore, as in the latter case, if large solids are drifted in the interpole space, a short circuit occurs between the electrode 12 and the work 11, thereby making it impossible to cause an electric discharge. Therefore, to form the coat 14 uniformly, and to achieve stable electric discharge, solids, which is formed due to the coagulation of the grain, having a size larger than the interpole distance should not be present in the powder that forms the electrode 12. Such coagulation of grains likely to occur in a metallic powder and conductive ceramic, and is less likely to occur in a non-conductive powder. The coagulation of grains becomes more likely to occur as the average grain diameter of the powder is made smaller. To avoid harmful effects due to solids caused by the coagulation of grains to be occurred during the electric discharge surface treatment, a process of sifting the powder coagulated at step S3 is required. For the purpose described above, a mesh size at the sifting should be smaller than the interpole distance.

Thereafter, to improve transmission of pressure from a press to a portion inside the powder at a subsequent pressing process, the powder is mixed with wax, such as paraffin, of approximately 1% to 10% in a weight percentage as required (step S4). If the powder is mixed with wax, formability improves, but the powder is again surrounded by a liquid, causing coagulation by the action of an intermolecular force or the electrostatic force and forming large solids. To fragmenting such solids formed with grains re-coagulated, the powder is sifted (step S5). A method of sifting at this step is carried out in a same manner as a method at step S3 described above.

Figure 3:
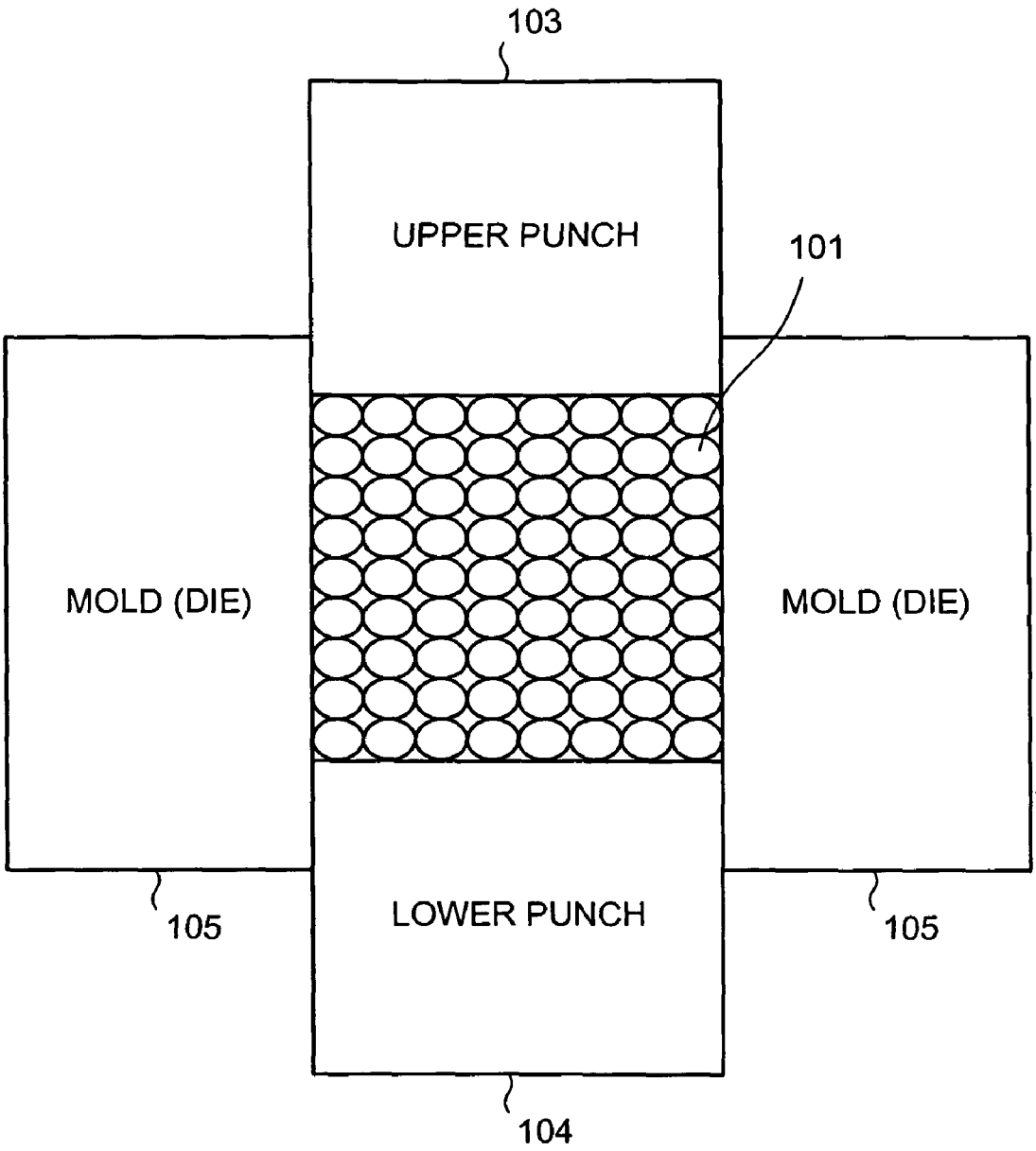
FIG. 3 is a cross-section of a molder for molding a powder.

Next, the powder obtained is molded by a compression press (step S6). FIG. 3 is a cross-section of a molder for molding the powder. A lower punch 104 is inserted from a lower portion of a hole formed on a mold (die) 105, and a space formed between the lower punch 104 and the mold (die) 105 is filled with the powder (when the powder is formed of a plurality of constituents, powder mixture) 101. An upper punch 103 is then inserted from an upper portion of a hole formed on the mold (die) 105. Then, the powder 101 is compression molded with a pressure applied by a pressurizer or the like from both sides of the molder filled with the powder 101 described above by the upper punch 103 and the lower punch 104. In the following, the powder 101 that is compression molded is referred to as a green compact. At this time, when a high pressure is applied, the electrode 12 becomes hard, and when a low pressure is applied, the electrode 12 becomes soft. Moreover, when a grain diameter of the powder 101 of the electrode material is small, the electrode 12 becomes hard, and when the grain diameter of the powder 101 is large, the electrode 12 becomes soft.

The green compact is then removed from the molder and heated in a vacuum furnace or a furnace filled with a nitrogen atmosphere, thereby obtaining a conductive electrode (step S7). At the time of heating, when a high heating temperature is applied, the electrode 12 becomes hard, and when a low heating temperature is applied, the electrode 12 becomes soft. By heating the green compact, it is also possible to decrease electric resistance of the electrode 12. Therefore, even if the powder is compression molded without mixing with wax at step S4, heating is meaningful. By heating, bonding among powder particles in the green compact proceeds, thereby producing an electrode for electric discharge surface treatment 12 that has conductivity.

The electrode for electric discharge surface treatment 12 can be molded even when the crushing process at step S1 described above is omitted, that is, even when the powder having an average grain diameter of several tens of μm is used as it is or when the sifting process at step S3 is omitted, and large solids as large as 0.3 mm or more are present. However, non-uniformity in hardness occurs in the electrode 12 such that hardness of a surface of the electrode is high and hardness of a center portion is low, which is not preferable. Moreover, in this electrode 12, the center portion is consumed through the electric discharge, but portions near the surface are not consumed. Thus, deposition to the surface of the work 11 is not proceeded, which is not preferable, either. In other words, the electrode material at a portion of a perimeter of the electrode 12 is too hard to be supplied, thereby causing the surface of the work 11 to be removed. On the contrary, since the center portion of the electrode 12 is brittle, it is consumed quickly after the process is started. As a result, the surface of the electrode 12 becomes such that its perimeter protrudes and its center portion is recessed. Since an electric discharge occurs only at the perimeter having a small interpole distance, removal of the surface of the work 11 proceeds, thereby making deposition impossible.

Furthermore, powders of Co, Ni (nickel), which are less likely to be oxidized, an alloy or oxide thereof, or ceramics having an average grain diameter thereof 3 μm or less are usually available on the market. Therefore, when any of these powders is used, the crushing process at step S1 and the drying process at step S2 described above may be omitted.

In the following, the present invention is described in more detail based on specific embodiments.

First, a stellite powder (a Co alloy having an average grain diameter of 50 μm), which is less likely to be oxidized under temperatures of 800 degrees Celsius (° C.) or lower was crushed by a vibrating mill to bring an average grain diameter to be 1.5 μm, and was then dried. A stellite used herein has a composition including 25 weight % Cr (chromium), 10 weight % Ni (nickel), 7 weight % W (tungsten), 0.5 weight % C (carbon), and Co for the rest.

Also, instead of the stellite having the above structure, a stellite having a composition including 28 weight % Mo (molybdenum), 17 weight % Cr, 3 weight % Si (silicon), and Co for the rest, or a stellite having a composition including 28 weight % Cr, 5 weight % Ni, 19 weight % W, and Co for the rest may be used.

Electrodes were manufactured using a non-sifted powder, and a sifted powder respectively. The dimensions of the mold used at the time of pressing were 18.2 mm in diameter and 30.5 mm in length. By using such a mold, the stellite powder was compression molded at a predetermined pressure of the press, and was then heated.

Figure 4:
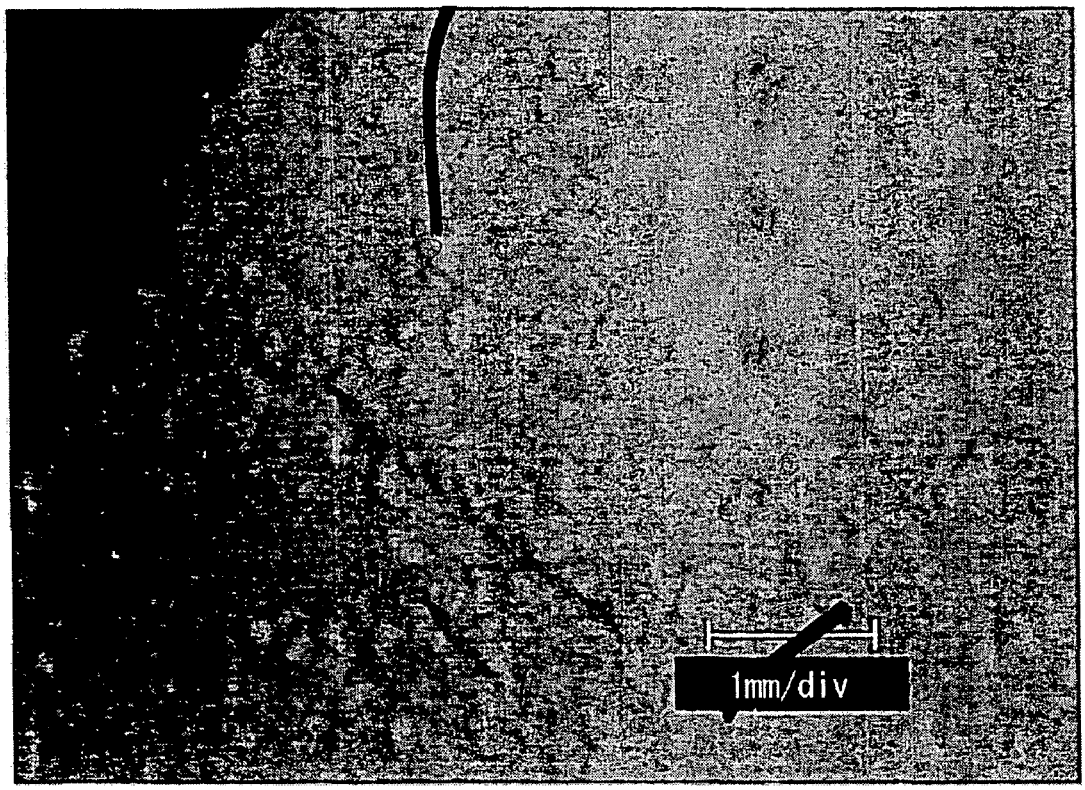
FIG. 4 is a photograph of a cross-section of an electrode manufactured without a sifting process.

Of the processes of manufacturing an electrode for electric discharge surface treatment described above, the sifting process after drying (step S3) and the sifting process after mixing paraffin (step S5) were omitted to manufacture an electrode, a section photograph (scaling: 35 times) of which is shown in FIG. 4.

To fragment the powder coagulated in the course of drying, a sifter having a mesh size of 0.15 mm was used for fine crushing and, after mixing with paraffin, a sifter having a mesh size of 0.3 mm was used to manufacture an electrode. A section photograph of the electrode thus manufactured is shown in FIG. 5.

First, the electrode shown in FIG. 4 is examined. A portion appearing white is a large solid, and it can be seen that many of such portions are present in a mixed manner. When the white portion is scratched by a pin, the portion appearing white is separated as a solid.

Figure 5:
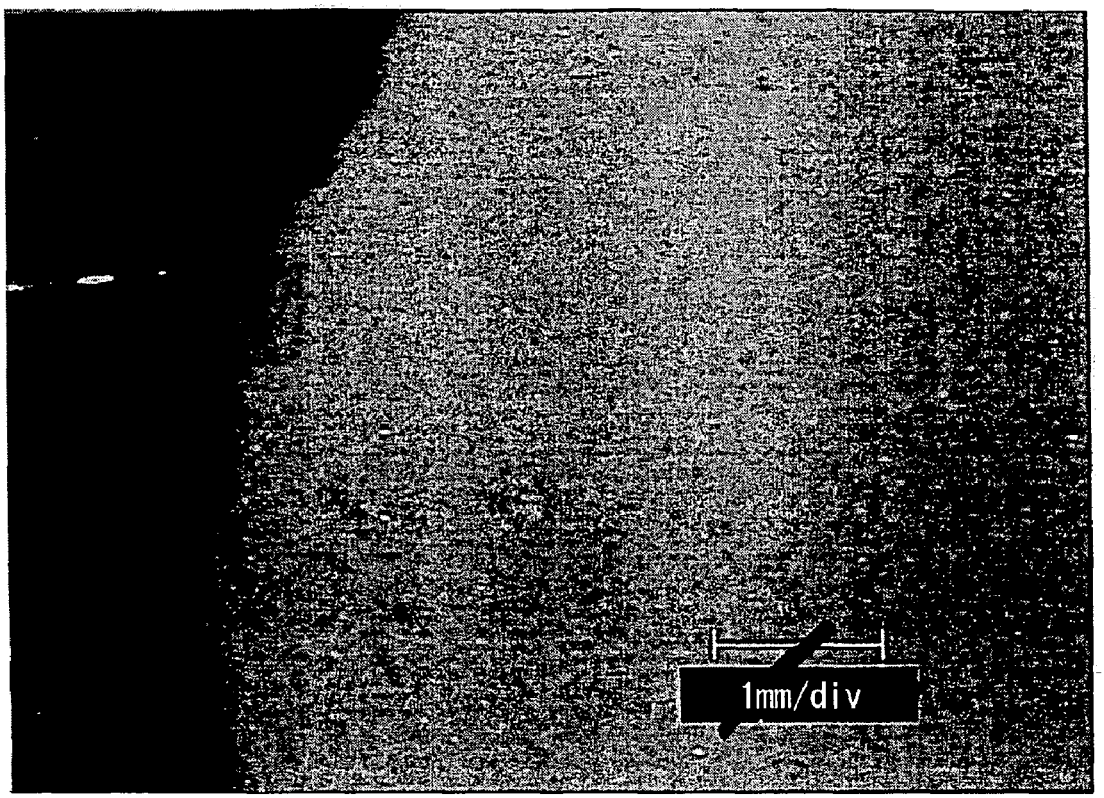
FIG. 5 is a photograph of a cross-section of an electrode manufactured with a sifting process.

On the other hand, when the electrode shown in FIG. 5 is examined, it is apparent that no such solid as seen in FIG. 4 is present.

Using these electrodes, electric discharge surface treatment was performed under various electric-discharge pulse conditions approximately to the extent that a peak current value ie=5 amperes (A) to 20 A, and an electric-discharge duration (electric discharge pulse width) te=4 microseconds (μs) to 100 μs. As for polarities, the electrode side was used as a minus polarity, while the work side was used as a plus polarity.

As a result, in the electric discharge surface treatment using the electrode manufactured with the sifted stellite powder, a coat having a film thickness of the order of 0.1 mm was able to be formed under any of the electric-discharge pulse conditions with a processing time of approximately five minutes. On the other hand, in the case of the electric discharge surface treatment using the electrode manufactured with the non-sifted stellite powder, a short circuit occurred to unstabilize the electric discharge, thereby preventing the process from proceeding, and making a deposition process impossible.

Thus, as described above, it was confirmed that there is the harmful effect due to the large solids of the stellite powder that is separated from the electrode without changing its size, and that is then deposited on the work or drifted between the poles filled with the dielectric fluid between the electrode and the work.

Figure 6:
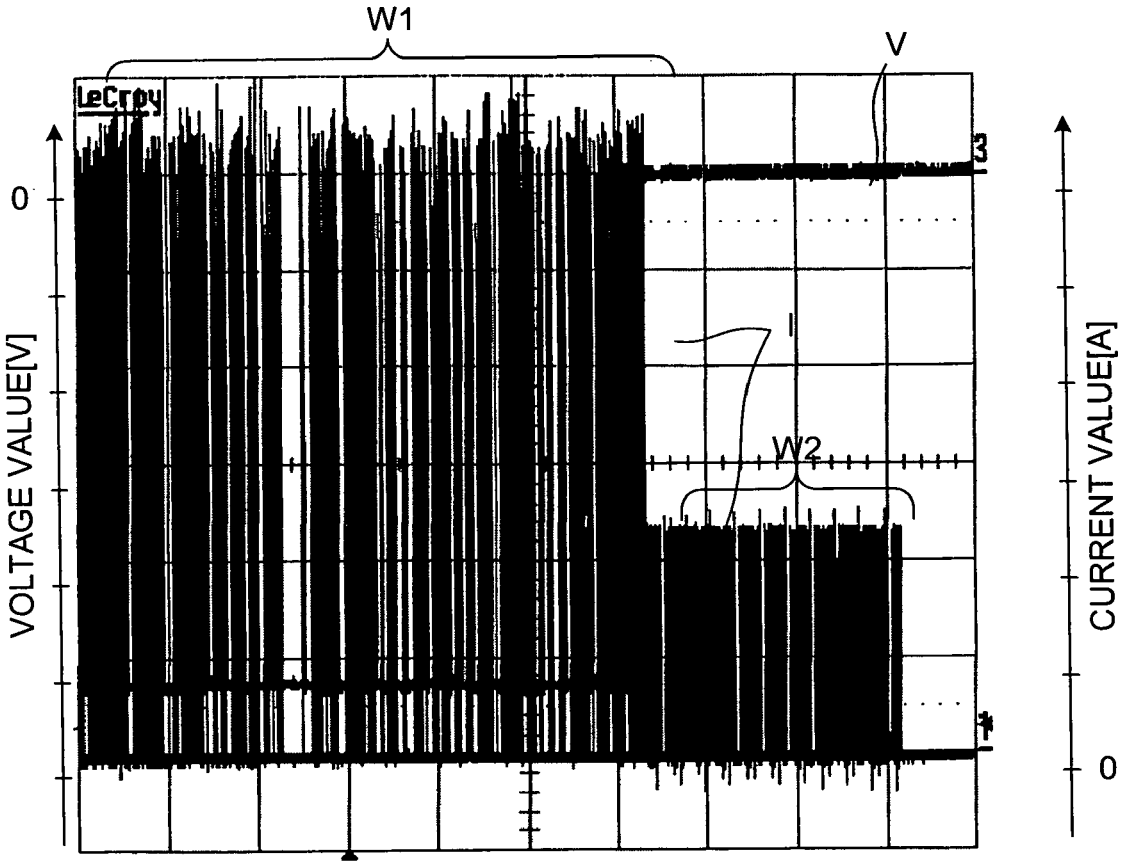
FIG. 6 is a graph of a current waveform and a voltage waveform between poles during electric discharge surface treatment.

FIG. 6 is a graph depicting one example of a current waveform and a voltage waveform between the poles during the electric discharge surface treatment. A waveform V shown in FIG. 6 at a portion near a top of the graph represents a voltage, and a waveform I shown in FIG. 6 at a portion near a bottom of the graph represents a current. On a vertical axis on a right end, an underline drawn under 1 represents 0 A, while an underline drawn under 3 represents 0 V. A horizontal axis represents time in 100 millisecond (ms) divisions, while vertical axes represent in 50 V divisions on top and in 5 A divisions on bottom. A waveform W1 shown on the left side from approximately the center of the drawing represents a waveform when a current is successfully generated with the application of a voltage. As for a waveform W2 shown on the right side from approximately the center of the drawing, a current waveform changes, while a voltage waveform does not change. When a current flows with a voltage being unable to be applied, a short circuit occurs between the poles. Therefore, it can be determined that the state represented by the waveform on the right side from approximately the center of the drawing is a short-circuit state.

Results similar to the above were obtained when an electric discharge surface treatment was performed using an electrode manufactured by sifting the powder after drying, fragmenting coagulated solids, and omitting a sifting process after mixing with paraffin.

Also when an electrode manufactured by sifting the stellite powder to eliminate large solids was used to perform a process (electric discharge surface treatment) under other conditions (electric-discharge pulse conditions), it was possible to achieve a stable electric discharge and to form a coat having a film thickness of the order of 0.1 mm with the process (electric discharge surface treatment) of five minutes.

Figure 7:
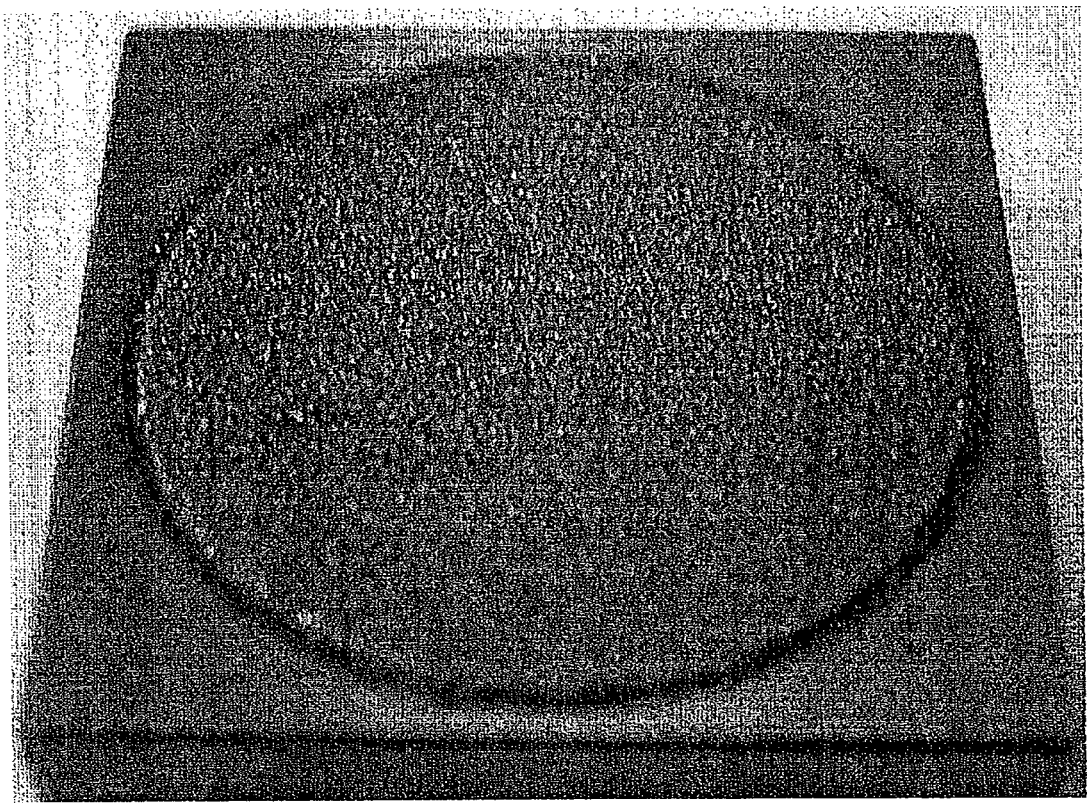
FIG. 7 is a photograph of a coat that is formed by electric discharge surface treatment using an electrode formed with a stellite powder sifted.

The coat formed by the electric discharge surface treatment using the electrode manufactured with the sifted stellite powder is shown in FIG. 7. Process conditions (electric-discharge pulse conditions) applied here are a peak current value ie=12 A, and an electric-discharge duration te=64 ms. When a short circuit occurs between the poles, a large solid may be deposited on the work or a hole may be formed on the coat. However, in FIG. 7, no projections and depressions were observed on the coat, and therefore it is evident that the coat was formed with a stable electric discharge.

According to the first embodiment, in the formation of an electrode by compression molding using a metallic powder or a ceramic powder, the electrode for electric discharge surface treatment manufactured does not include large solids formed due to the coagulation of the powder, specifically, those larger than a distance between the electrode and the work at the time of the electric discharge surface treatment. This can prevent situations such as large solids are deposited on the work or drifted between the poles during the electric discharge surface treatment, thereby achieving a stable electric discharge. As a result, a thick coat with a smooth surface can be obtained.

In addition to the conditions as described above, by including a predetermined amount (for example, 40 volume %) of a material hard to be carbonized in an electrode material, it is possible to obtain a thick coat more effectively.

When a powder having an average grain diameter of 3 μm or less is directly obtained from the market for manufacturing an electrode, the drying process (step S2) and the subsequent sifting process (step S3) are not required. Also, a powder produced by water atomization or the like has a spherical shape, and has a high moldability at the time of compression and shaping even without paraffin to be mixed. Therefore, when such a powder is used to manufacture an electrode, the paraffin mixing process (step S4) and the subsequent sifting process (step S5) are not required.

While a method in which an electrode is formed by compression molding a powder by a press has been explained, a method for forming the electrode is not limited to compression molding as long as the powder is molded into an electrode. Method for forming the electrode other than the method by compression molding include a method with slurry, a method by metal injection molding (MIM), a method by spraying, a method of molding nano powder on a jet stream, or the like. The fact is applicable also for following embodiments.

In the method with slurry, a powder is dispersed in a solvent, and is then put in a porous mold, such as a plaster mold, to remove the solvent, thereby molding the powder. In the MIM, a powder mixed with a binder is injected in a heated metal mold, thereby molding the powder. In the method by spraying, a powder that is heated is sprayed to be molded in a partially-bound state. Although the methods are different, a purpose of each of the methods is same, which is to mold a powder. If a binding state of the powder is in a desired state, the powder molded can be used as the electrode.

In the second embodiment, a Co powder having an average grain diameter of 1 mm was used to study a relation between the size of a mesh of a sifter and the coat thickness.

A sifted powder was used herein, the dimensions of a mold were 18.2 mm in diameter and 30.5 mm in length, and an electrode produced by compression molding the powder at a predetermined pressure of a press and then by heating a resultant compact was used. Process conditions are similar to those in the first embodiment, and the processing time was 10 minutes.

Figure 8:
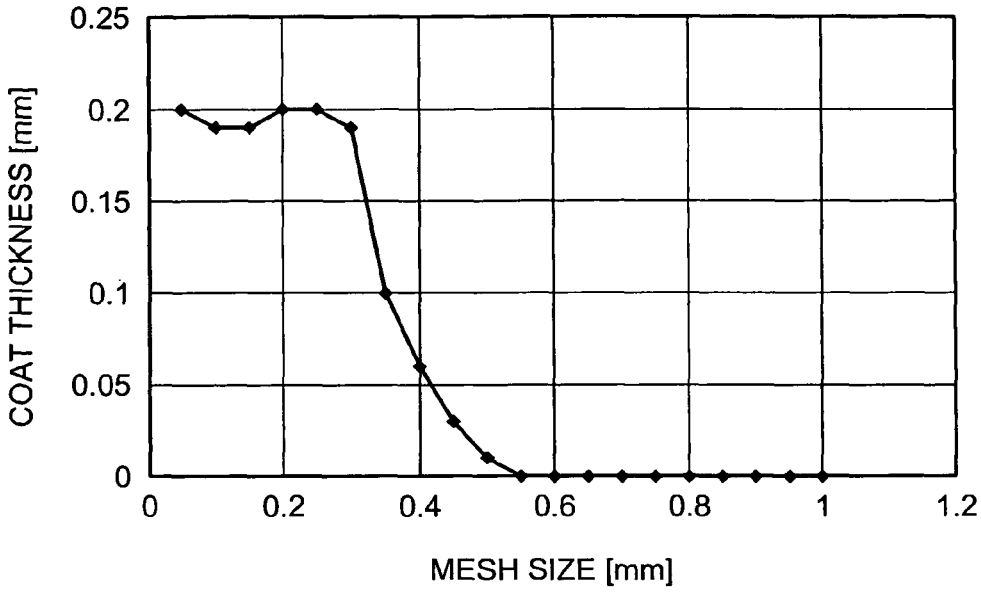
FIG. 8 is a plot of a relation between a mesh size of a sifter and a thickness of a coat.

The relation between the mesh size of the sifter and the coat thickness is shown in FIG. 8. The coat thickness shown in FIG. 8 represents an average value of the coat thickness measured at five points on the coat. It is apparent from FIG. 8 that, when the mesh size exceeded 0.3 mm, the coat thickness decreased with respect to a process time, and when the mesh size was over 0.5 mm, no coat was able to be deposited.

One reason for this is thought to be that, when the mesh size exceeds 0.3 mm, large solids that cannot possibly be dissolved by the electric discharge begin to appear between the poles and cause a short circuit or instability in the electric discharge, thereby decreasing the number of electric discharges and reducing the coat thickness. As described in the first embodiment, this can be understood from the interpole distance between the electrode and the work.

Figure 9:
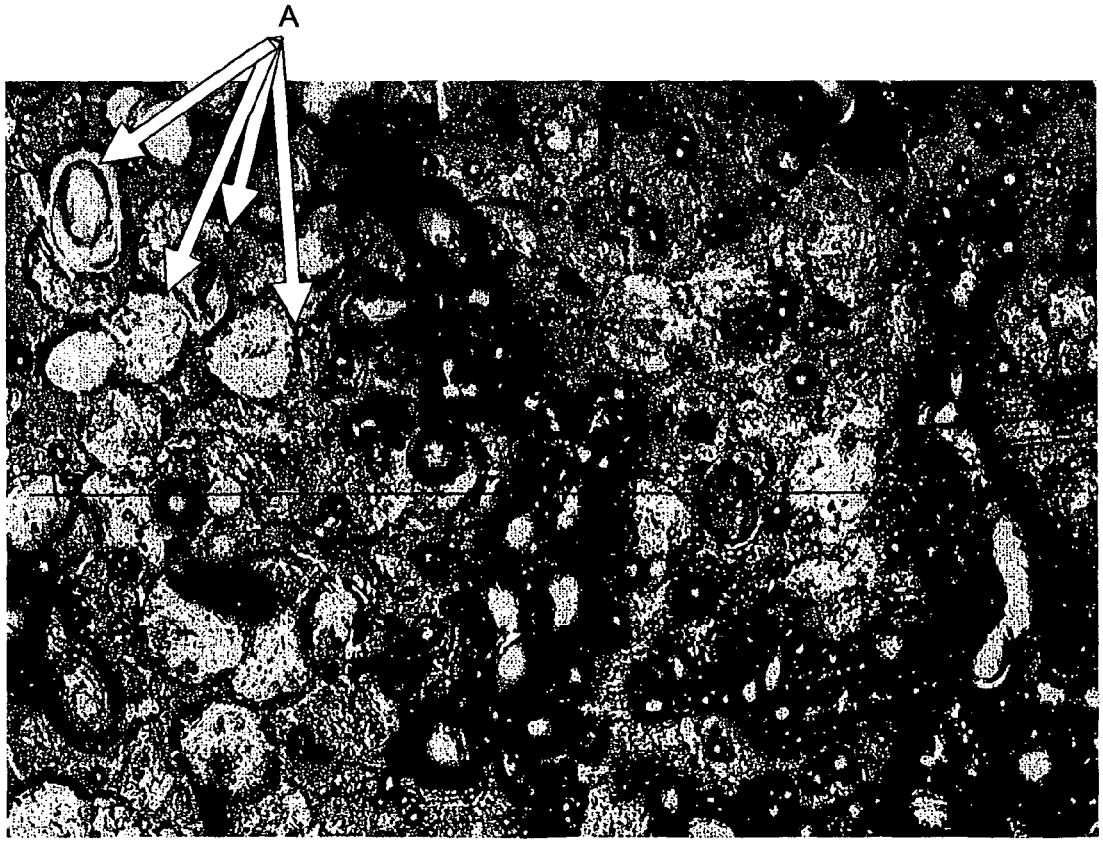
FIG. 9 is a photograph of a surface of a coat formed with an electrode that is manufactured using a sifter of which a mesh size is 0.5 mm.

A photograph of the surface of the coat based on an electrode manufactured using a sifter having a mesh size of 0.5 mm is shown in FIG. 9. From FIG. 9, it is apparent that small protruding particles A appear to be attached on the coat because large solids of the stellite powder cause a short circuit between the poles, thereby causing a large current to flow.

Also, an electric discharge occurs at a portion in which the electrode and the work are close to each other. It can therefore be concluded that, at portions other than the protruding portion, no electric discharge occur, and therefore, no coat can be formed.

According to the second embodiment, if the mesh size of the sifter is set as 0.3 mm, which is the distance between the electrode and the work, or smaller, it is possible to obtain a stable electric discharge and deposition of a thick coat.

In a third embodiment and fourth and fifth embodiments following the third embodiment, description is made to an electrode for electric discharge surface treatment that is used in forming a metallic coat by the electric discharge surface treatment, and that is formed with a powder of metal likely to be oxidized or an alloy including metal likely to be oxidized, and a method for manufacturing such an electrode.

The principle of the electric discharge surface treatment has been described in the first embodiment, and is therefore not described herein.

Figure 10:
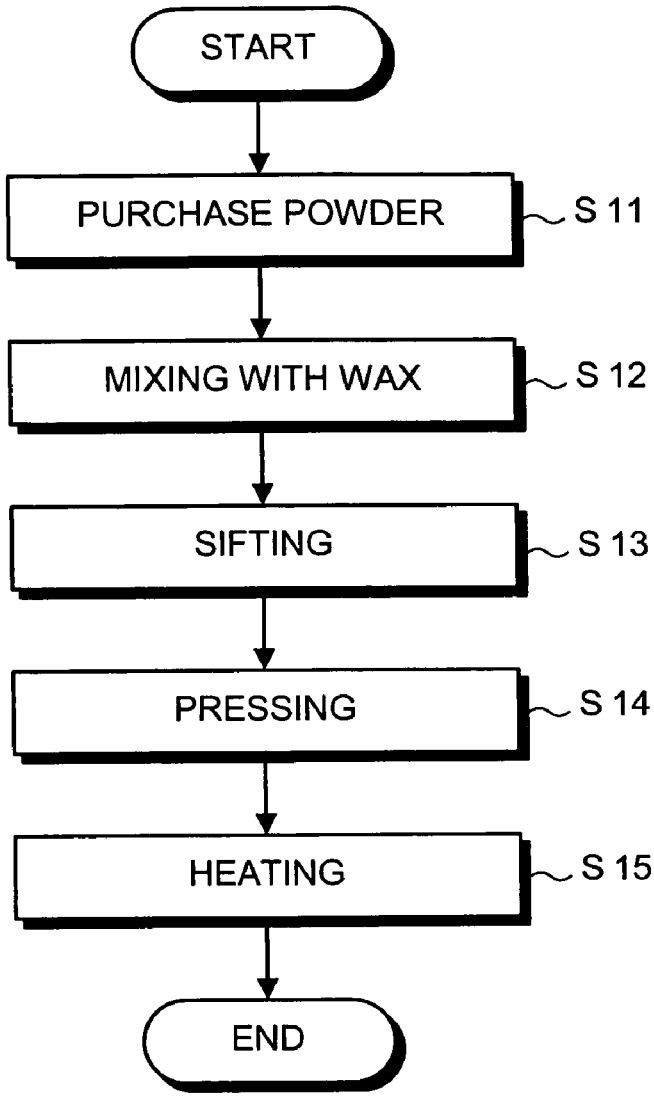
FIG. 10 is a flowchart of manufacturing an electrode for electric discharge surface treatment with a metallic powder or a ceramic powder having an average grain diameter of several μm.

Next, a method for manufacturing an electrode for electric discharge surface treatment is described. First, a method for manufacturing an electrode for electric discharge surface treatment manufactured with a metallic powder or a ceramic powder that are less likely to be oxidized as an electrode material is described. FIG. 10 is a flowchart of manufacturing such electrode for electric discharge surface treatment.

First, a powder of metal, a metallic alloy, or ceramics having a constituent of a coat desired to be formed on the work is purchased (step S11). Such a powder is available on the market and is a spherical powder of metal or ceramics that are less likely to be oxidized and that have an average grain diameter of several μm.

Then, to improve transmission of pressure from the press to a portion inside of the powder at a subsequent pressing process, the metallic powder, the metal alloy powder, or the ceramic powder is mixed with wax, such as paraffin, of approximately 1% to 10% in weight percentage as required (step S12).

If the powder and wax are mixed together, moldability improves. However, surrounding of the powder particles are again covered with a liquid, thereby causing coagulation by the action of an intermolecular force or the electrostatic force, and forming large solids. Thus, solids formed again due to the coagulation are sifted to be fragmented (step S13).

Next, the powder obtained is compression molded by a compression press (step S14). Compression molding of the powder is performed using a molder in the manner described in the first embodiment described above. In the following, a solid obtained by compression molding is referred to as a green compact.

Thereafter, the green compact is removed from the molder, and is then heated in a vacuum furnace or a furnace filled with the nitrogen atmosphere, thereby obtaining a conductive electrode (step S15). At the time of heating, when a high heating temperature is applied, the electrode becomes hard, and when a low heating temperature is applied, the electrode becomes soft. By heating the green compact, it is possible to decrease the electric resistance of the electrode. Therefore, even if the powder is compression molded without mixing with wax at step S12, heating is meaningful. With this, bonding among powder particles in the green compact proceeds, thereby obtaining an electrode for electric discharge surface treatment that has conductive.

An electrode for electric discharge surface treatment can be manufactured in the manner as described above using a metallic powder or a ceramic powder that are less likely to be oxidized as an electrode material.

However, not all kinds of metallic powders and ceramic powders that are less likely to be oxidized and that are available on the market are those having an average grain diameter of several μm. Moreover, metallic powders that are likely to be oxidized and that are available on the market are limited to those having an average grain diameter of 10 μm or more. In general, as the grain diameter of the powder decreases, a ratio of the surface area to the volume of the powder increases. In other words, a heat capacity of the powder decreases, and the powder becomes very sensitive to energy. Therefore, for example, when a metallic powder likely to be oxidized is surrounded by oxygen, the powder is oxidized very quickly to a portion inside the powder, thereby losing its properties as metal, such as conductivity and ductility. Furthermore, oxidation of the powder may explosively proceed. That is why the metallic powder likely to be oxidized and available on the market is limited to those having a large average grain diameter of 10 μm or more. The metal likely to be oxidized includes Cr (chromium), Al (aluminum), and Ti (titanium). However, even when any of such metallic powders likely to be oxidized is used as the electrode material, if the powder is compacted by compression molding to form an electrode, the surface of the electrode is oxidized, but the inside thereof is not so oxidized. In addition, the powder can be prevented from being explosively oxidized.

Figure 11:
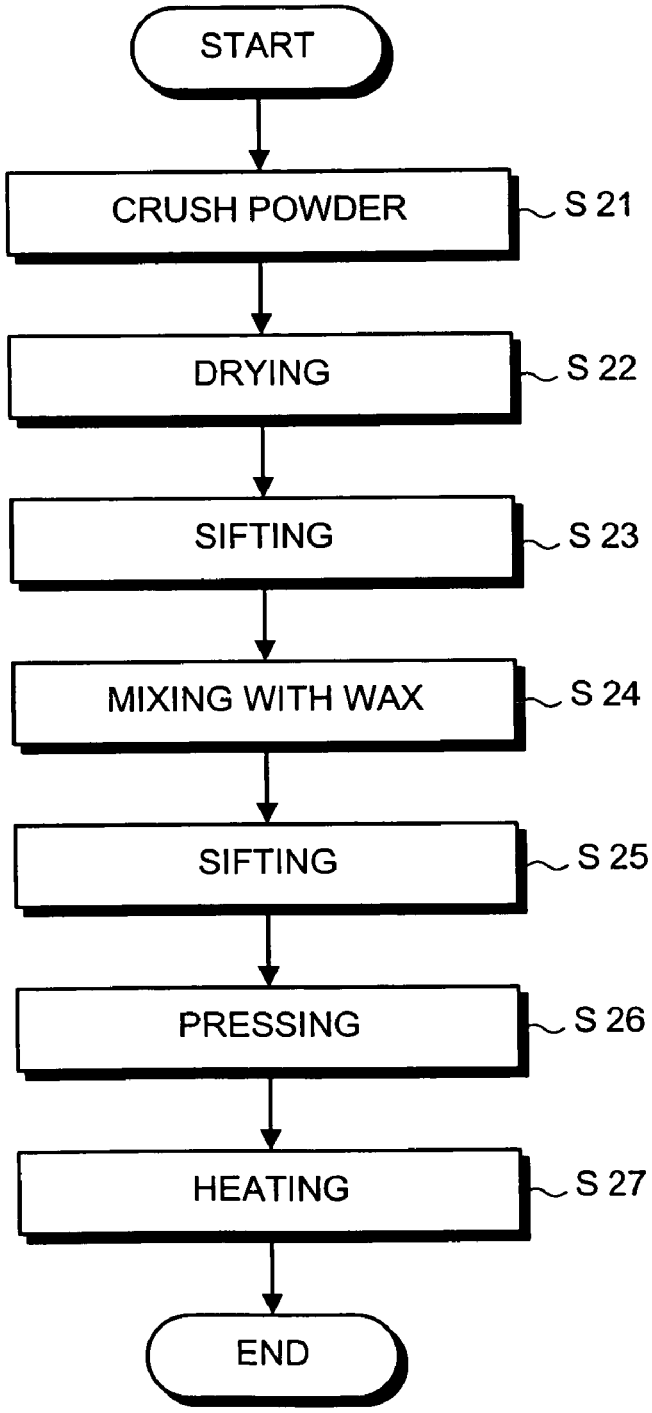
FIG. 11 is a flowchart of manufacturing an electrode for electric discharge surface treatment with a metallic powder less likely to be oxidized and having an average grain diameter of several tens of μm.

A method for manufacturing the electrode for electric discharge surface treatment formed with a commercially-available metallic powder that has an average grain diameter of several tens of μm, and that is less likely to be oxidized is described with reference to a flowchart shown in FIG. 11. First, the commercially-available metallic powder having an average grain diameter of several tens of μm and less likely to be oxidized is crushed with a mill, such as a ball mill, in volatile solvent of acetone or the like into particles having an average grain diameter of 3 μm or less (step S21). Then, the solvent is vaporized to dry the powder (step S22). Since the powder dried has large solids formed due to the coagulation of grains, to fragment these large solids and to sufficiently mix the powder with wax at a next step, the powder is sifted (step S23).

Thereafter, to improve transmission of pressure from the press to a portion inside of the powder at a subsequent pressing process, the powder is mixed with wax, such as paraffin, of approximately 1% to 10% in weight percentage as required (step S24). If the powder is mixed with wax, formability improves, but the powder is again surrounded by a liquid, thereby causing the coagulation by the action of an intermolecular force or the electrostatic force, and forming large solids. To fragment the solids formed due to the re-coagulation, the powder is sifted (step S25).

Next, the powder obtained is compression molded by a compression press (step S26). Compression molding of the powder is performed using a molder in the manner described in the first embodiment described above. In the following, a solid of the powder obtained by compression molding is referred to as a green compact.

The green compact is then removed from the molder, and is then heated in a vacuum furnace or a furnace filled with a nitrogen atmosphere, thereby obtaining a conductive electrode (step S27). At the time of heating, when a high heating temperature is applied, the electrode becomes hard, and when a low heating temperature is applied, the electrode becomes soft. By heating the green compact, it is possible to decrease electric resistance of the electrode 12. Therefore, even if the powder is compression molded without mixing with wax at step S14, heating is meaningful. With this, bonding among powder particles in the green compact proceeds, thereby manufacturing an electrode for electric discharge surface treatment that has conductivity.

An electrode for electric discharge surface treatment can be manufactured in the manner as described above using a commercially-available metallic powder having an average grain diameter of several tens of μm and less likely to be oxidized.

However, when an electrode is manufactured by this method by using a metallic powder likely to be oxidized, the metallic powder is oxidized in the drying process described above. Therefore, this manufacturing method cannot be directly applied to a process of manufacturing an electrode formed with a metallic powder likely to be oxidized.

Figure 12:
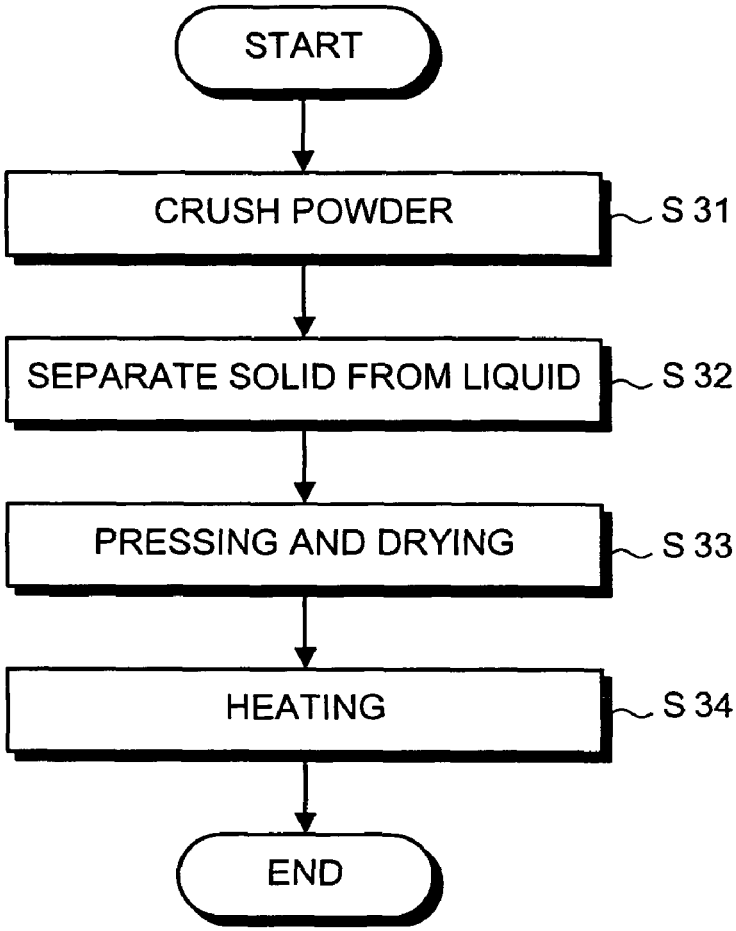
FIG. 12 is a flowchart of manufacturing an electrode for electric discharge surface treatment with a metallic powder likely to be oxidized and having an average grain diameter of several tens of μm.

FIG. 12 is a flowchart of manufacturing an electrode for electric discharge surface treatment according to the present invention. A commercially-available metallic powder likely to be oxidized has an average grain diameter of several tens of μm.

First, the commercially-available metallic powder having an average grain diameter of several tens of μm and likely to be oxidized is crushed with a mill, such as a ball mill, in volatile alcohol or solvent (hereinafter, "solvent medium") into grains having an average grain diameter of 3 μm or less (step S31).

After crushing, the metallic powder and the solvent medium are put in a container for separation into solid and liquid. Specifically, the electrode powder, that is, the metallic powder, is caused to settle in the solvent medium for removal of a supernatant of the solvent medium to obtain only the metallic powder (step S32). The metallic powder at this time is not oxidized because the solvent medium is sufficiently contained.

Next, the metallic powder obtained is compression molded by a compression press without being dried (step S33). In the following, a solid obtained by compression molding the metallic powder is referred to as a green compact. Compression molding of the powder is performed using a molder in the manner described in the first embodiment described above. In the present invention, the metallic powder is left being pressed by the press until a shape of an electrode is obtained, while volatilizing the solvent medium. When a liquid having a low boiling point, such as acetone, is used as the solvent medium, the solvent medium volatilizes within no more than several minutes.

It was found that, when a powder of a material of which a specific gravity is approximately 8 is used for an electrode, when the powder is molded with approximately 4% in weight percentage or more of the solvent, such as acetone or alcohol, being left, oxidation of the material is suppressed. It was found that the oxidation of the material abruptly proceeds if the powder is dry, in other words, if a rate of the solvent included in the powder becomes less than 4%. Since a ratio of the solvent that should be left in the powder is based on a volume percentage, when a powder of a material to be used for the electrode has a low specific gravity, a weight percentage increases.

In this process, since what is required is that the solvent medium is dried to the extent that the green compact can keep its shape, the solvent medium does not have to be completely volatilized. Therefore, if the green compact has been dried to an extent sufficient to keep its shape, the green compact can be extracted from the molder before the solvent medium is completely dried.

Where there is no oxidized coat on the surface of the metallic powder, particles of the metallic powder forms a metallic bond. Therefore, when a metallic powder is used as an electrode material, an electrode having strength to some extent can be molded. Moreover, even with a metallic powder likely to be oxidized, the metallic power is not oxidized as far as a portion inside the metallic powder if compacted. This is because each metallic powder particle is bonded with its many surrounding particles to have an increased ratio of the volume to the surface area (this is virtually the same as having an increased grain diameter), and therefore becomes insensitive to heat generated when the metallic powder is oxidized.

Furthermore, when the electrode (compact) is dried, a little space is left in a portion occupied by the solvent medium, that is, a portion between metal particles in the electrode. The volume of the space and oxygen that is present therein are so small that oxidation of the metallic powder does not go beyond oxidation of its surface.

Then, once an oxidized coat is formed on the surface of the metallic powder, the metallic powder is in an extremely chemically-stable condition (in a high entropy condition). Therefore, even when the metallic powder having the oxidized coat formed thereon is exposed in air, a portion inside is not oxidized. Therefore, by performing steps S31 to S33 described above, oxidation of the metallic powder can be prevented from going beyond the oxidation on the surface.

Thereafter, heating is performed in a vacuum furnace or a furnace filled with a nitrogen atmosphere, thereby producing a conductive electrode (step S34). Even when the green compact is not completely dried during pressing, it is possible to make the solvent completely volatile during the heating process.

An electrode for electric discharge surface treatment can be manufactured in the manner as described above using a commercially-available metallic powder that has an average grain diameter of several μm and that is likely to be oxidized.

In the manufacturing method described above, if the mold is appropriately heated (approximately at a boiling point of a solvent medium) during pressing, it is possible to reduce time required for volatilizing the solvent medium. For example, when acetone is used as the solvent medium, it is preferable that the mold be heated at the order of 60° C. If the mold is heated at such high temperatures as 300° C. to 1000° C., the metallic powder is melted, or bonding of the metallic powder proceeds too much. Such problems do not occur with the temperature of the order of degrees above.

Also, even when the solvent medium is completely volatilized at the stage of pressing the metallic powder, the green compact formed of the metal likely to be oxidized is still in a solid state. Therefore, each metallic powder particle forming the green compact is bonded with its many surrounding metallic powder particles to have an increased ratio of the volume to the surface area (this is virtually the same as having an increased grain diameter), and therefore, becomes insensitive to heat generated when the metallic powder is oxidized. Thus, the portion inside of the powder is not oxidized.

If a metallic powder having a low moldability is used, such a metallic powder including acetone or ethanol should be mixed with wax before compression molding. Moldability can be improved if the powder is mixed with wax, such as paraffin, of approximately 1% to 10% in weight percentage to improve the transmission of pressure from the press to a portion inside of the powder at the time of a pressing process. However, when wax is used, acetone may dissolve the wax. Therefore, it is preferable to use alcohol, such as ethanol, at the time of crushing.

After the wax is mixed in the metallic powder including acetone or ethanol, sifting is performed. The powder obtained is compression molded by a compression press in a manner similar to that above, and is then heated by a vacuum furnace or a furnace filled with a nitrogen atmosphere, thereby manufacturing a conductive electrode. The wax in the electrode is removed at the time of heating.

Also, if the metallic powder is crushed in wax, no alcohol or the like needs to be used. However, when wax is used for crushing by a ball mill or the like, wax reduces a ball speed because it generally has a high viscosity, thereby reducing the crushing capability. Therefore, as for a bead mill, it is required to increase rotation speed of the mill to obtain approximately the same crushing capability as that of the crushing capability obtained when acetone or ethanol is used. As for a vibration mill, it is required to increase its amplitude and vibration speed.

Next, examples of a solvent medium to be volatized are shown in Table 1.

TABLE 1

| Substance | Boiling point |
|---|---|
| Toluene | 110.6 |
| Xylene | 139.1 |
| MEK | 79.6 |
| Normal hexane | 67 |
| Isooctane | 99.2 |
| Benzene | 80.1 |
| Acetone | 56 |
| Ethanol | 78 |
| Propanol | 97.2 |
| Butanol | 128.8 |

The solvent media shown in Table 1 are examples of a solvent medium usable for the present invention. Therefore, in this invention, any solvent medium can be used as long as it has a boiling point of around 100° C., and as long as the solvent medium does not corrode a container or a press used in crushing. However, in consideration of environment, alcohols, such as ethanol, are preferable.

In addition, if a solvent medium having a boiling point near 60° C. is used, because such solvent medium quickly volatilizes, a time required for volatilizing at the time of pressing can be shortened. However, an operation between processes has to be done quickly. If the operation requires some time, it is preferable to use a solvent medium having a boiling point as high as possible, although the time required for volatilizing is thereby lengthened.

Next, an example of manufacturing an electrode for electric discharge surface treatment using Cr (chromium) as metal likely to be oxidized is described. In general, a commercially-available Cr powder has an average grain diameter of the order of 10 μm. Such a powder was first crushed with a vibration-type ball mill. Crushing conditions are depicted in Tables 2 and 3.

TABLE 2

| | |
|---|---|
| Ball material | Zr02 |
| Diameter | φ½ |

TABLE 3

| | |
|---|---|
| Pot material | Zr02 |
| Pot capacity | 3.6 L |
| Powdering method | Wet |
| Material injection amount | 1 kg |
| Solvent medium | Ethanol |

The material of a ball and a container of the vibration-type ball mill was $ZrO_2$, and a size of the ball was ½ inch. 1 kilogram (kg) of a Cr powder was put in a 3.6-liter container, and the container was filled with ethanol. The container was then vibrated to crush the Cr powder. As a result, the average grain diameter of the Cr powder was able to be reduced to 2.0 μm.

Next, the Cr powder crushed was extracted together with ethanol to let the Cr powder precipitate in ethanol. The Cr powder was allowed to precipitate for approximately 1 hour, thereby making it possible to separate the Cr powder and ethanol. Thereafter, a supernatant of ethanol was removed, thereby obtaining a Cr powder containing a large amount of ethanol.

Next, approximately 32 grams (g) of the Cr powder obtained was taken out to be compression molded. A mold having dimensions of 18.2 mm in diameter and 30.5 mm in length was used. With the mold, the state in which a predetermined pressure of the press was applied to the Cr powder was kept for approximately 5 minutes, thereby evaporating ethanol and making a green compact of the Cr powder to be enough hard to keep a shape.

Then, this compact was heated in a vacuum furnace at a predetermined heating temperature for approximately 4 hours to manufacture a conductive electrode. Ethanol was completely evaporated during heating and was removed from the electrode.

Through the processes described above, it was possible to manufacture a conductive Cr electrode with oxidation of the Cr powder proceeding only on a surface and without oxidation proceeding to in a portion inside of the Cr powder.

Figure 13:
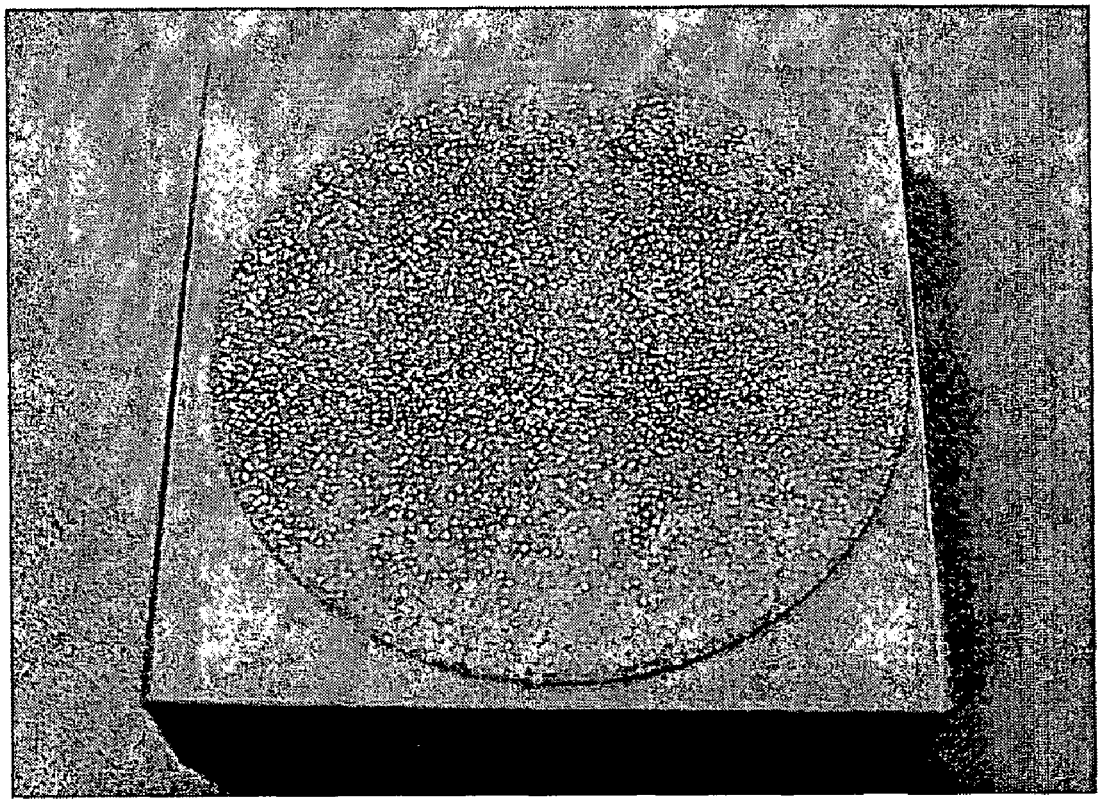
FIG. 13 is a photograph of a coat formed by electric discharge surface treatment.

Next, a depositing process (electric discharge surface treatment) was performed using the electrode for electric discharge surface treatment manufactured with the Cr powder as the electrode material. Process conditions were such that the peak current value ie=12 A, and the electric-discharge duration (electric discharge pulse width) te=approximately 8 μs. As a result of the process (the electric discharge surface treatment) performing for 3 minutes, a coat having a thickness of approximately 1 mm was able to be formed. A photograph of the coat formed by the electric discharge surface treatment is depicted in FIG. 13. In the photograph shown in FIG. 13, a thick coat of approximately 1 mm formed is shown. Concentration of the electric discharge or occurrence of a short circuit was not observed on a surface of the coat, and therefore, it can be assumed that a stable electric discharge had proceeded.

Effects similar to those in the case of Cr described above were able to be obtained with Ti or Al, for example, which is metal likely to be oxidized.

According to the third embodiment, even when a metallic powder that is likely to be oxidized, and that has a grain diameter thereof 3 μm or less is used, an electrode for electric discharge surface treatment can be manufactured with oxidation of the metallic powder proceeding only on a surface and without oxidation proceeding at a portion inside of the metallic powder. Thus, metal likely to be oxidized can be selected as an electrode material for an electrode for electric discharge surface treatment, and a thick coat of metal likely to be oxidized, such as Ti, Al, or Cr, can be formed in a non-oxidized state by an electric discharge surface treatment.

When a non-oxidized coat is oxidized in high-temperature environments, abrasion resistance and heat resistance can be obtained. Such coat characteristics enables to expand the technical field to which the coat is applicable.

Moreover, also in the present embodiment, it is possible to obtain a thick coat having a smooth surface by excluding, when a metallic powder or a metallic compound powder is used to manufacture an electrode by compression molding, large solids formed due to the coagulation of powder particles, specifically, large solids of which a diameter is equal to or shorter than the distance between the electrode and the work, at the time of the electric discharge surface treatment.

Furthermore, also in the present embodiment, a Co alloy powder, for example, a stellite powder, can be used as a metallic compound powder.

Moreover, in addition to the conditions as described above, by including a predetermined amount (for example, 40 volume %) of a material hard to be carbonized in an electrode material, it is possible to obtain a thick coat more effectively.

Figure 14:
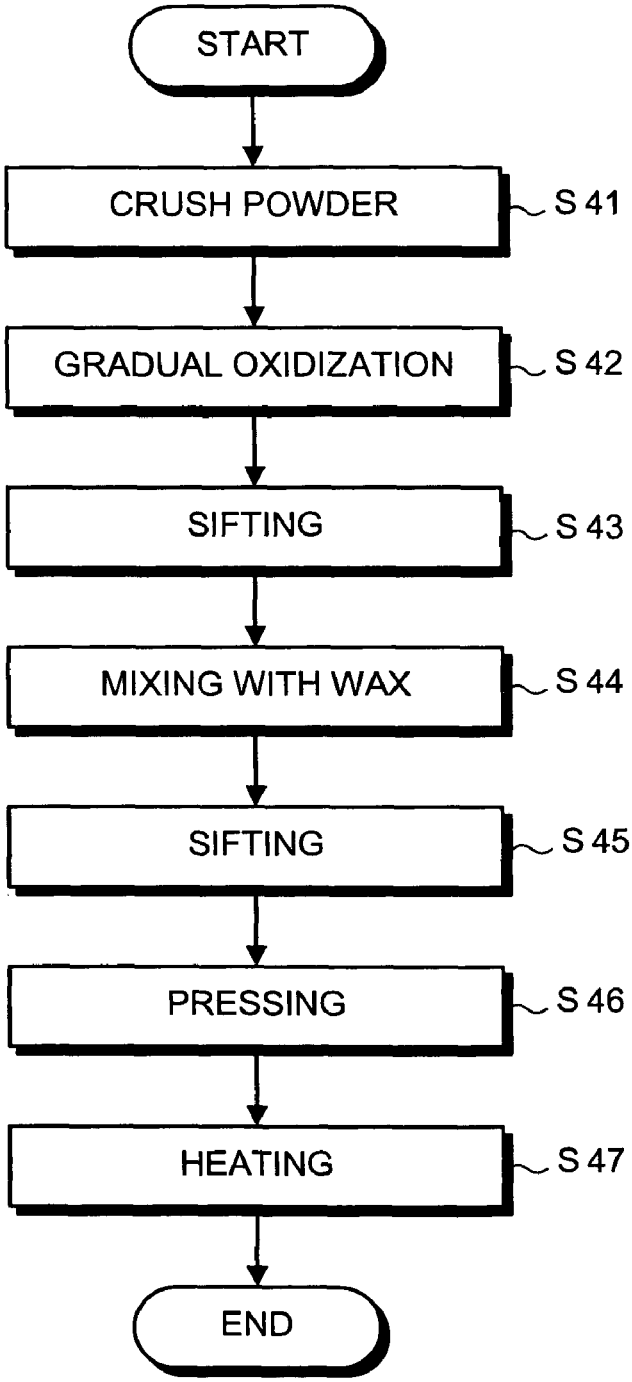
FIG. 14 is a flowchart of a process of manufacturing another electrode for electric discharge surface treatment according to embodiments of the present invention.

In the fourth embodiment, a method for manufacturing another electrode for electric discharge surface treatment according to the present invention is described. FIG. 14 is a flowchart of manufacturing the electrode for electric discharge surface treatment. A commercially-available metallic powder likely to be oxidized has an average grain diameter of approximately 10 μm.

First, a commercially-available metallic powder likely to be oxidized and having an average grain diameter of approximately 10 μm is crushed in acetone, which is highly volatile, with a mill, such as a ball mill apparatus, into particles having an average grain diameter of 3 μm or less (step S41).

Then, the metallic crushed powder is dried in a nitrogen atmosphere or an inert gas atmosphere. Next, only a surface of the powder is oxidized while slightly taking air in (step S42). When the metallic powder likely to be oxidized is exposed to oxygen, the metallic powder is oxidized, as a matter of course. However, if there is not enough oxygen to oxide a portion inside the metallic powder, oxidation of the metallic powder proceeds only on the surface of the powder. Once an oxidized coat is formed on the surface of the metallic powder, the metallic powder is in an extremely chemically-stable condition (in a high entropy condition). Therefore, even when the metallic powder having the oxidized coat formed thereon is exposed in air, the portion inside is not oxidized. Such a process of forming an oxidized coat on a metallic powder is referred to as a gradual oxidizing process.

When the metallic powder is exposed to air suddenly, oxidation proceeds to a portion at a center of the metallic powder. When the portion inside of the metallic powder is oxidized, the metallic powder loses its conductivity, and never forms an electric-dischargeable electrode even if the metallic powder is pressed and heated. However, when oxidation of the metallic powder proceeds only on the surface of the powder, particles are pressed to each other by a press to break the oxidized coat, thereby allowing a metallic bonding among metallic powder particles. Therefore, if oxidation of the metallic powder proceeds only on the surface of the powder, a conductive electrode can be produced. A metallic bonding between metallic powder particles can be promoted also in a heating process described below.

The metallic powder after drying may form large solids due to the coagulation of particles. To improve the transmission of pressure of the press to the portion inside the powder at the pressing process, the powder is mixed with wax, such as paraffin, of approximately 1% to 10% in weight percentage before pressing, thereby making it possible to improve formability of the metallic powder. For this purpose, the metallic powder after drying is sifted so that wax, such as paraffin, and the metallic powder are mixed well with each other, thereby clearing the coagulation of the metallic powder (step S43).

Thereafter, to improve the transmission of pressure from the press to the portion inside the powder at the pressing process, the powder is mixed with wax, such as paraffin, of approximately 1% to 10% in weight percentage as required before pressing (step S44). Mixing the powder with wax improves formability, but the powder is again surrounded by a liquid, thereby causing the coagulation by the action of the intermolecular force or the electrostatic force, and forming large solids. To fragment the solids formed due to the re-coagulation, the powder is sifted (step S45).

Next, the powder obtained is molded by a compression press (step S46). Compression molding the powder is performed using a molder in the manner described in the first embodiment described above. In the following, a solid of the powder obtained by compression molding is referred to as a green compact.

Thereafter, the green compact is removed from the molder, and is then heated in a vacuum furnace or a furnace filled with a nitrogen atmosphere, thereby obtaining a conductive electrode (step S47).

An electrode for electric discharge surface treatment can be manufactured in the manner as described above with, as an electrode material, a commercially-available metallic powder that has an average grain diameter of approximately 10 μm, and that is likely to be oxidized.

Next, an example in which Cr (chromium) is used as metal likely to be oxidized to manufacture, by the manufacturing method as described above, an electrode for electric discharge surface treatment is described below. In general, a Cr powder commercially available has an average grain diameter of the order of 10 μm. Such a powder was first crushed by a vibration-type ball mill. Crushing conditions were similar to those in the third embodiment described above, and crushing was performed under conditions similar to those shown in Tables 1 and 2. That is, the material of a ball and a container in the vibration-type ball mill was $ZrO_2$, and the size of the ball was ½ inch. 1 kg of a Cr powder was put in a 3.6-liter container, and the container was filled with acetone as a solvent medium. The container was then vibrated to crush the Cr powder. As a result, the average grain diameter of the Cr powder was able to be reduced to 2.0 μm.

Next, the Cr powder after crushing was put in a container and placed in a drying apparatus, and then was dried by being cooled with chiller water at a temperature of approximately 10° C. The Cr powder dried weighed approximately 1 kg. Furthermore, the Cr powder dried was uniformly spread at a bottom of an approximately 100-liter container. The container was first filled with nitrogen, and then air is injected at 0.2 liter (L) per minute in the container so that a volume ratio of nitrogen and air was 9:1. Then, in this state, the temperature inside the container was kept at 60° C. and left for approximately 5 hours. In this manner, the surface of the Cr powder crushed was slightly oxidized. In other words, the surface of the Cr powder crushed was gradually oxidized.

If a pressure of a press is lowered at the time of compressing and molding the Cr powder, electric resistance of the electrode for electric discharge surface treatment manufactured is of the order of 10 kilo-ohms (kΩ), and therefore, an electric discharge cannot be achieved even by performing an electric discharge surface treatment using the electrode for electric discharge surface treatment. However, if the pressure of the press is increased to some extent at the time of compressing and molding, the oxidized coat of the Cr powder is broken, thereby reducing the electric resistance of the electrode manufactured to approximately 10.

With an oxidized coat being formed on the surface of the metallic powder, the metallic powder is chemically stabilized, and is therefore, easy to handle as normal ceramics. With such a chemically-stable metallic powder, an electrode for electric discharge surface treatment can be molded by a manufacturing method similar to the conventional method.

However, an oxide is generally non-conductive. Therefore, a conductive electrode for electric discharge surface treatment cannot be manufactured unless the oxidized coat of the metallic powder is broken by heating or pressing. With an electrode for electric discharge surface treatment manufactured without the oxidized coat of the metallic powder being broken, that is, a non-conductive electrode for electric discharge surface treatment, an electric discharge cannot be generated, as a matter of course. To solve the problem, the oxidized coat of the metallic powder should be broken by applying a predetermined pressure at the time of compression molding, thereby causing a metallic bond between metallic powders. As a result, the electrode manufactured has conductivity, and with the electrode, it is possible to generate an electric discharge, thereby making the electric discharge surface treatment possible.

Thereafter, to fragment the Cr powder coagulated through the drying process, a sifter having a mesh size of 0.15 mm was used to finely crush the Cr powder. Then, the Cr powder finely-crushed was mixed with paraffin of 8% in weight percentage, and was then finely crushed again by a sifter having a mesh size of 0.05 mm.

Next, approximately 32 g of the Cr powder obtained was taken out to be compression molded. A mold having dimensions of 18.2 mm in diameter and 30.5 mm in length was used. Then, the green compact was heated in a vacuum furnace at a predetermined heating temperature for a predetermined time to manufacture a conductive electrode.

With the processes described above, it was possible to obtain a conductive Cr electrode without oxidation proceeding to a portion inside of the Cr powder and with oxidation of the Cr powder proceeding only on a surface.

Next, a depositing process (electric discharge surface treatment) was performed using the electrode for electric discharge surface treatment manufacture with this Cr powder as the electrode material. Process conditions were such that the peak current value ie=12 A, and the electric-discharge duration (electric discharge pulse width) te=approximately 8 μs. As a result of the process (the electric discharge surface treatment) performing for 3 minutes, a coat having a thickness of approximately 1 mm was able to be formed. Concentration of the electric discharge or occurrence of a short circuit was not observed on a surface of the coat, and therefore, it can be assumed that a stable electric discharge had proceeded.

In the foregoing, description has been made to a case of manufacturing an electrode for electric discharge surface treatment by using a metallic powder likely to be oxidized. A Co alloy powder having a lubrication property and corrosion resistance under a high-temperature environment is also oxidized if including metal likely to be oxidized. Therefore, the present invention is applied also to the case of manufacturing an electrode for electric discharge surface treatment using an alloy powder that includes metal likely to be oxidized and has an average grain diameter one of 1 μm, thereby making it possible to manufacture a conductive alloy electrode without oxidation proceeding to a portion inside of the alloy powder and with oxidation of the alloy powder proceeding only on a surface.

As described above, according to the fourth embodiment, even when a metallic powder likely to be oxidized and having a grain diameter thereof 3 μm or less is used, an electrode for electric discharge surface treatment can be manufactured without oxidation proceeding to the portion inside of the metallic powder and with oxidation of the metallic powder proceeding only to the surface. Thus, metal likely to be oxidized can be selected as an electrode material for an electrode for electric discharge surface treatment, and a thick coat of metal likely to be oxidized, such as Ti, Al, or Cr, can be formed as being in a non-oxidized state by the electric discharge surface treatment.

Also, according to the fourth embodiment, since a gradual oxidizing process is performed after crushing the powder, an oxidized coat is formed on the surface of the metallic powder likely to be oxidized, thereby obtaining a chemically-stable metallic powder. As a result, the powder becomes easy to handle as ceramics. With such a chemically-stable metallic powder, even if it is a metallic powder likely to be oxidized, an electrode for electric discharge surface treatment can be manufactured by a manufacturing method similar to the conventional method.

In the fifth embodiment, a method for manufacturing an electrode for electric discharge surface treatment using a powder finely crushed in wax is described.

A heating wire is wound around a side surface of a container of a mill container, such as a ball mill apparatus. An input to the heating wire is adjusted such that an inner wall of the container becomes at a temperature of 60° C. to 80° C. Alcohol (propanol or butanol) having a boiling point of 100° C. or higher is then put in the container. Next, wax of 5 weight % to 10 weight % in weight percentage with respect to a powder to be crushed is put in the container. Wax having a melting point of approximately 50° C. is used. After wax is sufficiently melted by being stirred in the container, a ball made of zirconia for crushing and the powder to be crushed are put in the container. The amount of each input is similar to that in the third embodiment. The kinematic viscosity of the melted wax is approximately three times as high as the kinematic viscosity of alcohol, thereby increasing an influence the solvent medium on the ball in resistance. To complete crushing within a time as short as the time required fro crushing when alcohol is used, it is required to increase the number of vibrations to some extent.

After the powder is crushed to have a desired grain diameter, vibration is stopped. Next, the input to the heating wire is increased to bring the temperature approximately to the boiling point of alcohol to volatilize alcohol. At this time, caution is required so that the temperature is kept below 230° C., which is the flash point of wax. Upon completion of volatilization of alcohol (the weights of the input powder and wax are known), heating process ends. When the heating process is finished, wax coagulates due to a decrease in temperature. At this time, coagulation of wax proceeds while the powder and wax are stirred. When the temperature is becomes as low as approximately a room temperature, an electrode is completed through processes identical to the sifting process at step S45 shown in FIG. 14 according to the fourth embodiment.

According to the fifth embodiment, by performing crushing in wax, the powder is covered with wax even after alcohol is dried, and therefore does not make contact with air, thereby obtaining a powder that is not oxidized. Also, compared with the manufacturing method according to the fourth embodiment, the sifting process can be omitted.

First, in this embodiment, a concept for forming a dense thick coat by the electric discharge surface treatment is described.

In the conventional electric discharge surface treatment, an electrode material, such as Ti, is chemically reacted in oil through electric discharge to form a hard carbide coat. Therefore, the electrode for electric discharge surface treatment includes a large amount of material easy to form carbide.

Also, as the electric discharge surface treatment proceeds, a material on a surface of a work piece (work) is changed, thereby changing characteristics, such as a thermal conductivity and a melting point, accordingly. For example, when the electric discharge surface treatment is performed on steel, as the electric discharge surface treatment proceeds, the material of the surface of the work piece (work) is changed from steel to TiC, which is ceramic. Accordingly, characteristics, such as the thermal conductivity and the melting point, are changed.

Through experiments performed by the inventors, it has been found that, in such a coat formation process, by adding a material less likely to be carbonized to constituents of the electrode material, a thick coat can be formed. This is because addition of the material less likely to be carbonized to the electrode increase the amount of materials that remain on the coat remaining to be in the same metal state without becoming a carbide. This has an important significance when forming a thick coat.

Examples of an electrode for electric discharge surface treatment with which formation of a thick coat is possible as described above are listed below. The temperatures in the heating process shown below were obtained through experiments performed by the inventors.

(1) Electrode for electric discharge surface treatment manufactured by compression molding a Co powder and by further performing a heating process When the Co powder has a grain diameter of the order of 4 μm to 5 μm, the temperature in the heating process after compression molding is preferably 400° C. to 600° C. When the Co powder has a grain diameter of the order of 1 μm, the temperature in the heating process after compression molding is preferably 100° C. to 300° C. When the Co powder has a grain diameter further smaller than 1 μm, the temperature in the heating process after compression molding may be 200° C. or lower, or in some cases, the heating process is not required.

(2) Electrode for electric discharge surface treatment manufactured by compression molding a powder of an alloy hard to form a carbide, such as Co, and by further performing a heating process An electrode for electric discharge surface treatment manufactured by compression molding a Co-based alloy powder (a grain diameter of 1 μm to 3 μm) that includes 25 weight % Cr (chromium), 10 weight % Ni (nickel), 7 weight % W (tungsten), and the like, and by further performing the heating process can also form a dense thick coat. The temperature in the heating process after compression molding is preferably higher than that for the Co powder because of a material difference, of the order of 700° C. to 900° C.

While in the above, two examples of the electrode for electric discharge surface treatment have been listed, there are many other examples, since it is found that with any electrode, a thick coat can be formed by the electric discharge surface treatment, as long as certain conditions are satisfied, such that a predetermined amount (for example, 40 weight % or more) of a material hard to be carbonized should be included.

Other than the above, using, for example, Fe (iron) as the electrode material, with an electrode for electric discharge surface treatment formed of a 100% Fe (iron) material, or with an electrode for electric discharge surface treatment formed of a steel material, formation of a thick coat by the electric discharge surface treatment is possible. Also, other than the above, an electrode for electric discharge surface treatment formed of Ni (nickel) or the like allows formation of a thick coat in a electric discharge surface treatment.

Moreover, through experiments conducted by the inventors, it has been found that, in some cases, even with a material forming a carbide, if the material is finely crushed to be a powder particle of which a grain diameter is 1 μm or less to manufacture an electrode for electric discharge surface treatment, carbonization of the electrode material at the time of the electric discharge surface treatment is suppressed, and it is possible to form a thick coat. Such materials include, for example, Cr (chromium) and Mo (molybdenum).

Through studies performed by the inventors, it has been found that, in the technique of forming a thick coat by the electric discharge surface treatment described above, variations in coat thickness of the coat formed occur in some cases. An Example of such a case is described below.

A Co-based alloy powder (a grain diameter of 1 μm to 3 μm) that includes 25 weight % Cr (chromium), 10 weight % Ni (nickel), 7 weight % W (tungsten), and the like was compression molded, and then the heating process was further performed at a temperature of 800° C. to manufacture an electrode for electric discharge surface treatment. Then, the electric discharge surface treatment was performed using this electrode for electric discharge surface treatment to form a coat on a work of an Ni alloy. Specific description is provided below.

Figure 15:
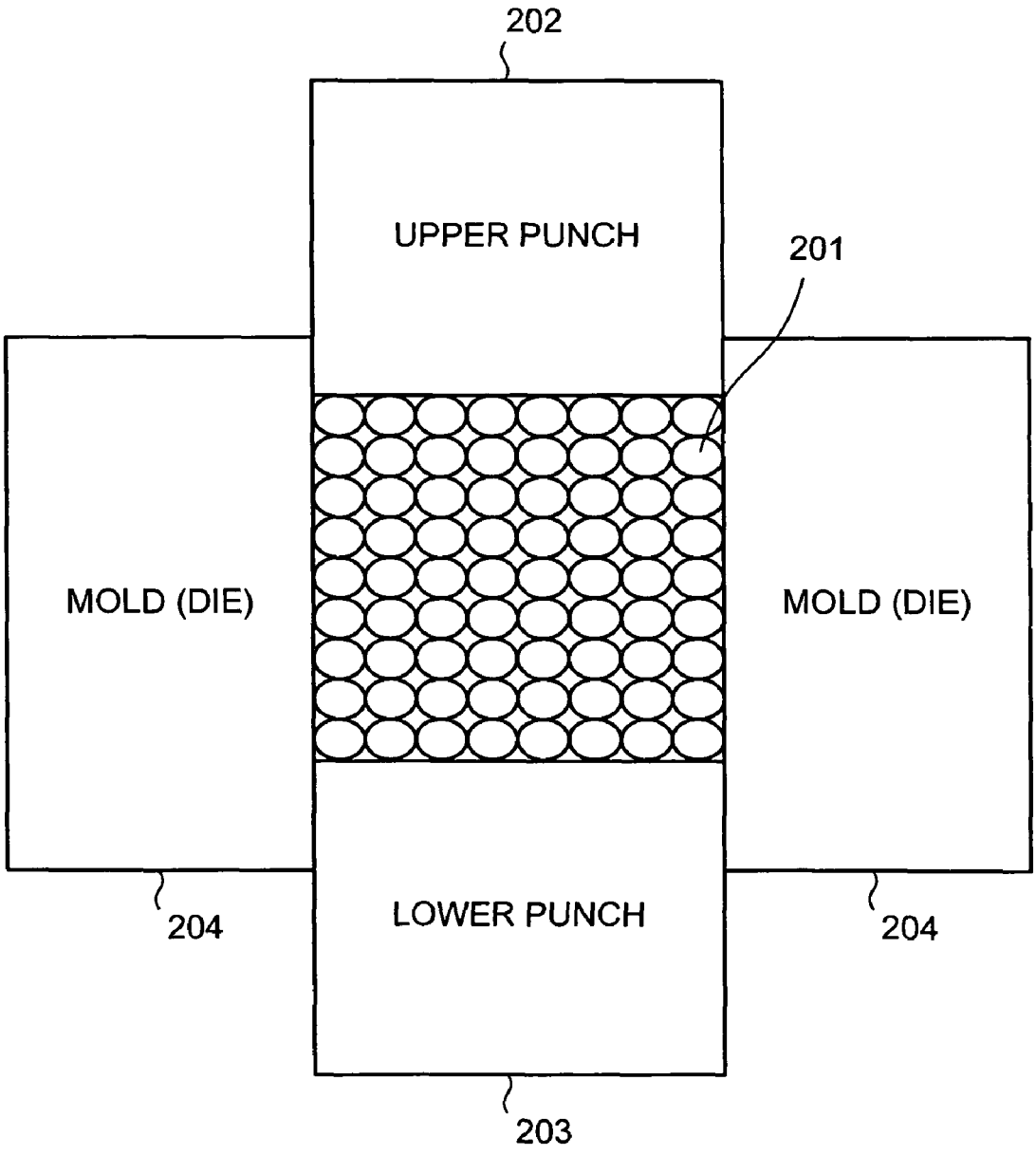
FIG. 15 is a cross-section of a molder for molding a powder.

First, the electrode for electric discharge surface treatment was manufactured. FIG. 15 is a cross-section of a molder for molding the powder. A lower punch 203 was inserted from a lower portion of a hole formed on a mold (die) 204, and a space formed between the lower punch 203 and the mold (die) 204 was filled with a Co-based alloy powder 201 including 25 weight % Cr (chromium), 10 weight % Ni (nickel), 7 weight % W (tungsten), and the like.

Then, an upper punch 202 was inserted from an upper portion of the hole formed on the mold (die) 204. Then, the alloy powder 201 was compression molded by a pressure applied by a pressurizer or the like from both sides of the molder filled with the powder 201 described above by the upper punch 202 and the lower punch 203. In the following, the alloy powder 201 compression molded is referred to as a green compact. At this time, when a high pressure is applied, the electrode becomes hard, and when a low pressure is applied, the electrode becomes soft. Also, when the grain diameter of the alloy powder 201 of the electrode material is small, the electrode becomes hard, and when the grain diameter of the alloy powder 201 is large, the electrode becomes soft.

The green compact is then removed from the molder and heated in a vacuum furnace at a temperature of 800° C., thereby obtaining a conductive compact electrode, that is, the electrode for electric discharge surface treatment.

To improve the transmission of pressure from the press to a portion inside of the alloy powder 201 at the time of compression molding, the alloy powder 201 is mixed with wax, such as paraffin, thereby improving moldability of the alloy powder 201. However, since wax is an insulating material, if a large amount of wax remains in the electrode, the electric resistance of the electrode increases, thereby degrading the electric discharge property.

Therefore, when wax is mixed in the alloy powder 201, it is preferable that wax is removed. Wax can be removed by putting the green compact in the vacuum furnace to be heated. In addition, by heating the green compact, it is possible to decrease the electric resistance of the green compact, and to increase strength of the green compact. Therefore, even when wax is not mixed, heating after compression molding is meaningful.

Figure 16:
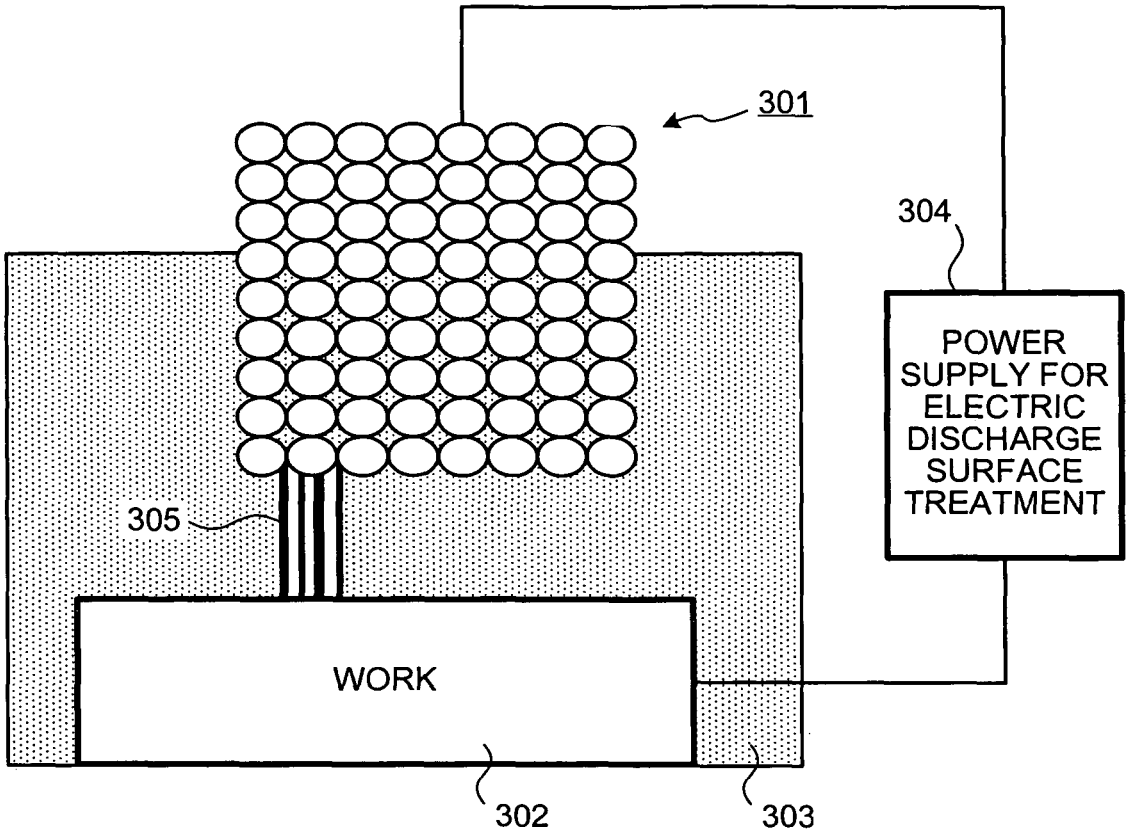
FIG. 16 is a conceptual view of electric discharge surface treatment performed by an apparatus for electric discharge surface treatment.

Next, the electric discharge surface treatment was performed using the electrode for electric discharge surface treatment manufactured in the manner described above to form a coat the work of the Ni alloy. The electric discharge surface treatment performed by an apparatus for electric discharge surface treatment using the electrode for electric discharge surface treatment for the purpose of formation of a thick coat manufactured in the processes described above is shown in FIG. 16. In FIG. 16, a state is shown in which a pulse-like electric discharge occurs.

The apparatus for electric discharge surface treatment shown in FIG. 16 includes an electrode for electric discharge surface treatment 301 (hereinafter, simply "electrode 301"), a dielectric fluid 303 covering an electrode 301 and a work 302 made of the Ni alloy, and a power supply for electric discharge surface treatment 304 that causes a pulse-like electric discharge by applying a voltage between the electrode 301 and the work 302. In FIG. 16, a servo mechanism for controlling an interpole distance, that is, a distance between the electrode 301 and the work 302, a depot storing the dielectric fluid 303, and the like are omitted because they are not directly related to the present invention.

To form a coat with this apparatus for electric discharge surface treatment, the electrode 301 and the work 302 are placed in the dielectric fluid 303 to be opposed to each other. Then, in the dielectric fluid 303, a pulse-like electric discharge is caused between the electrode 301 and the work 302 by using the power supply for electric discharge surface treatment 304. Specifically, a voltage is applied between the electrode 301 and the work 302 to cause an electric discharge. As shown in FIG. 16, an arc column of electric discharge 305 occurs between the electrode 301 and the work 302.

Then, with the electric discharge energy of the electric discharge occurring between the electrode 301 and the work 302, a coat of the electrode material is formed on a surface of the work, or a coat of a substance resulting from reaction of the electrode material due to the electric discharge energy is formed on the surface of the work. As for polarities, the electrode 301 has a negative polarity, while the work 302 has a positive polarity.

Figure 17A:
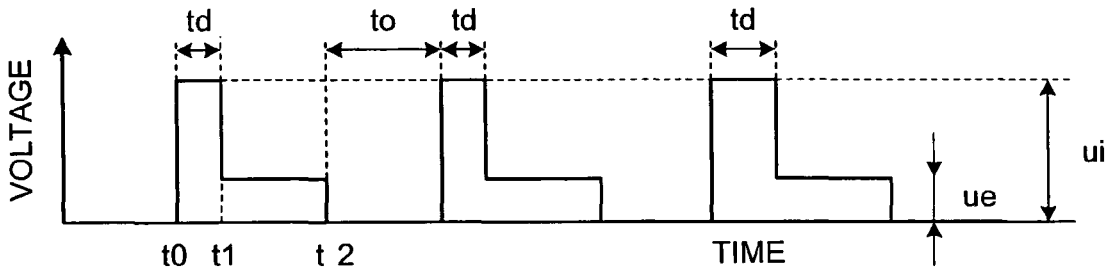
FIG. 17A is a plot of a voltage waveform (waveform of an interpole voltage) between an electrode and a work at a time of electric discharge.
Figure 17B:
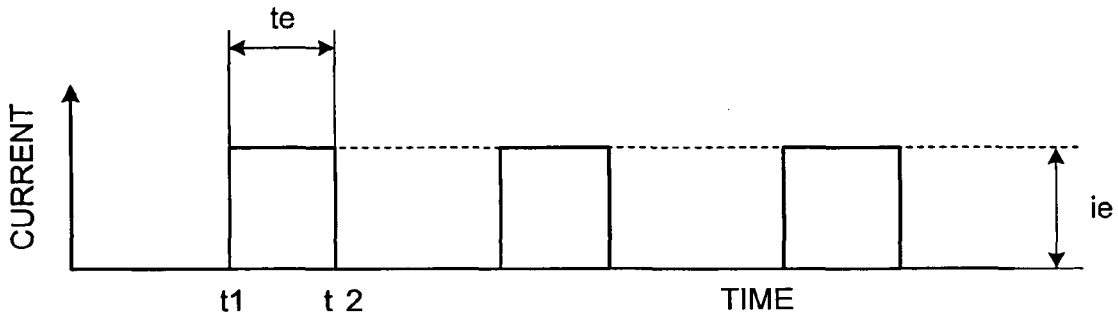
FIG. 17B is a plot of a current waveform of a current flowing through the apparatus at the time of electric discharge.

Examples of pulse conditions of the electric discharge for performing the electric discharge surface treatment in the apparatus for electric discharge surface treatment having such a structure as described above are shown in FIGS. 17A and 17B. FIGS. 17A and 17B are diagrams of examples of pulse conditions of electric discharge in the electric discharge surface treatment, in which FIG. 17A depicts a voltage waveform (waveform of an interpole voltage) between the electrode 301 and the work 302 at the time of electric discharge, while FIG. 17B depicts a current waveform of a current flowing through the apparatus for electric discharge surface treatment at the time of electric discharge. A voltage value and a current value are each positive in a direction of an arrow shown in each of FIGS. 17A and 17B, that is, in an upper direction of a vertical axis. Also, the current value is positive when the electrode 301 side has a negative polarity, while the work 302 is as a positive-polarity electrode.

As shown in FIG. 17A, a no-load voltage ui is applied between both poles at a time t0. A current begins to flow at a time t1 after an electric-discharge delay time td has elapsed, thereby starting the electric discharge. The voltage at this time is an electric-discharge voltage ue, and the current at this time is represented by a peak current value ie. Then, when the supply of the voltage between both poles is stopped at a time t2, the current stops flowing.

A duration between t2 to t1 is referred to as an electric-discharge pulse width te. A voltage waveform in a duration between t0 to t2 is repeatedly applied between both poles at intervals of a pause time to. That is, as shown in FIG. 17A, a pulse-like voltage is applied between the electrode 301 and the work 302.

The pulse conditions used in the present embodiment are such that the peak current value ie=10 A, and the electric-discharge duration (electric discharge pulse width) te=8 μs, the pause time to=16 μs, and a processing time is 10 minutes. Also, an electrode area (that is, an area to be processed) is equivalent to the area of a circle of which a diameter is 18 mm.

A dense, thick coat was able to be formed by performing an electric discharge surface treatment with the structure and conditions described above. However, a problem occurred in which, the coat thickness of the coat formed differed every time the process was performed even with the process performed under the same conditions and for the same time duration. Specifically, the amount of deposition (coat thickness) of the coat when a brand-new electrode 301 was used was approximately 150 μm, while the coat thickness of the formed coating when an electrode 301 previously used several days ago was used for performing an electric discharge surface treatment was approximately 100 μm.

If the coat thickness of the formed coating varies even if the process is performed under the same conditions, it is inconvenient in view of automating the process when, for example, coatings are successively formed on the same component. That is, since the coat thickness of the coat cannot be controlled, a coat is formed to be thick, and then a process of removing an excess coating is required. This is disadvantageous in terms of process time and cost.

Upon a survey of a cause of such variations in coat thickness of the coat, it has turned out that the cause of variations in coat thickness of the coat is due to an inflow of oil, which is a dielectric fluid used in the electric discharge surface treatment, in the space between the poles. Since the electrode for electric discharge surface treatment is compression molded from a powdered material, its inside is in a state where many spaces are present. Then, several tens of % of a volume of the electrode is such spaces, and these spaces play an important role in forming a coat by the electric discharge surface treatment.

For example, when too many spaces are present inside the electrode, the strength of the electrode is low. Therefore, the electrode material is not normally supplied by an electric-discharge pulse and a phenomenon occurs such that, upon impact of the electric discharge, the electrode collapses over a wide range. On the other hand, if too few spaces are present, the electrode material is too closely and firmly formed, thereby causing a phenomenon of a short supply of the electrode material by an electric-discharge pulse and making it impossible to form a thick coat.

As such, the spaces in the electrode for electric discharge surface treatment are important in forming a coat. On the other hand, it has been found through experiments performed by the inventors that the spaces in the electrode for electric discharge surface treatment also produce variations in coat thickness of the coat. That is, when the electrode for electric discharge surface treatment is brand-new, the spaces in the electrode are in a hollow state. By contrast, as the number of time for which the electrode is used for the electric discharge surface treatment increases, oil, which is the dielectric fluid, flows into the spaces inside the electrode, and the spaces are filled with oil.

Following effects are caused when the spaces in the electrode for electric discharge surface treatment are filled with the dielectric fluid.

(1) The strength of the electrode is increased because of viscosity of the dielectric fluid in the spaces in the electrode;

(2) An operation of cooling the electrode at the time of the electric discharge surface treatment is enhanced because the dielectric fluid is present in the spaces in the electrode; and (3) When the dielectric fluid is evaporated after the dielectric fluid enters the spaces in the electrode, only a material having high viscosity, that is, resistant to vaporization, remains in the electrode, thereby increasing the strength of the electrode.

With these three effects above, the electrode can be prevented from being excessively consumed due to the electric discharge at the electric discharge surface treatment, thereby making it easy to form a dense coating. On the other hand, however, the above (three) effects mentioned above vary with time, which causes the variations in the coat thickness of the coat. Therefore, the more the electrode is used, that is, the more the electrode is soaked in the dielectric fluid, the thinner the coat becomes even though the electric discharge surface treatment is performed under the same conditions and for the same time duration. Hence, the thickness of the coat decreases.

To prevent this, the present embodiment has a feature in which the electrode for electric discharge surface treatment is soaked in a dielectric fluid to fill the spaces in the electrode with the dielectric fluid in advance, thereby suppressing variations in coat thickness of the coat at the time of the electric discharge surface treatment.

That is, in a method for manufacturing an electrode for electric discharge surface treatment according to the present invention, after a powdered material, that is, any one of a metallic powder, a metal compound powder, and a ceramic powder, is compression molded to form a green compact, oil or a dielectric fluid used in the electric discharge surface treatment is caused to flow into the space inside the green compact. The processes up to the process of forming the green compact are similar to those for manufacturing the electrode for electric discharge surface treatment described above.

The electrode for electric discharge surface treatment is manufactured in the manner described above, and the electrode is filled with oil or a dielectric fluid used in the electric discharge surface treatment in the space inside the electrode for electric discharge surface treatment in advance before being used for the electric discharge surface treatment.

When the green compact electrode, that is, the electrode for electric discharge surface treatment, is used for forming a coat by the electric discharge surface treatment, the electric discharge surface treatment is performed with the electrode of which the space in the electrode for electric discharge surface treatment is filled with oil or the dielectric solution. Therefore, variations that occur in process between a brand-new electrode and an electrode for which a predetermined time has elapsed since manufactured can also be minimized.

Figure 18:
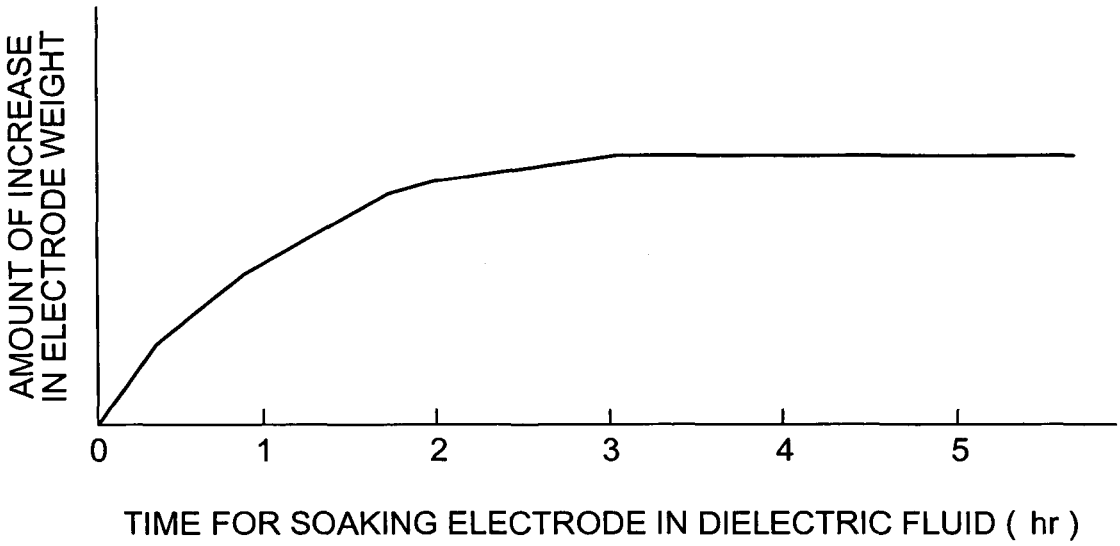
FIG. 18 is a graph of a change in a weight of an electrode according to a time for soaking the electrode in a dielectric fluid.

FIG. 18 depicts a state in which a weight of the electrode increases according to a time for soaking the electrode in a dielectric fluid. Amount of increase in weight of the electrode is equivalent to an amount of the dielectric fluid absorbed in the electrode. From FIG. 18, it can be assumed that the dielectric fluid flows into the space in the electrode within 2 hors to 3 hours.

The present invention is described in more detail below based on a specific embodiment.

A Co-based alloy powder (a grain diameter of 1 μm to 3 μm) that includes Cr (chromium), Ni (nickel), W (tungsten), and the like was compression molded, and then the heating process was further performed at a temperature of 800° C. Thereafter, the electrode having been soaked in the dielectric fluid for 30 hours was used for the electric discharge surface treatment for a work of an Ni alloy. Here, electric-discharge pulse conditions were such that the electrode for use had an electrode area (that is, an area to be processed) of 18 mm, and the peak current value is 10 A, the pulse width is 8 μs, and the pause time is 16 μs, and the process was performed for 10 minutes.

As a result, an amount of deposition (coat thickness) with the use of a brand-new electrode was approximately 100 μm, and the amount when a process was performed 7 days later under the same conditions was also approximately 100 μm. Thus, variations in thickness of the coat were able to be nearly solved.

Results similar to those described above were able to be obtained even with the electrode for electric discharge surface treatment manufactured with a Mo powder and an alloy powder including Mo; an Fe powder and an alloy powder including Fe; and an Ni powder.

According to the sixth embodiment, the compact electrode manufactured, that is, the electrode for electric discharge surface treatment, is soaked in advance in the dielectric fluid used in the electric discharge surface treatment, and then the electric discharge surface treatment is performed with the green compact electrode of which the spaces inside are filled with the dielectric fluid. Therefore, the variations that occur in the process between a brand-new electrode and even an electrode produced after a predetermined time has elapsed can also be minimized.

In the sixth embodiment, a stage of manufacturing an electrode was has been described. In the present embodiment, a method of storing the electrode is described.

When the electrode for electric discharge surface treatment (compact electrode) is stored, if the electrode is stored in air, the dielectric fluid in the spaces inside the electrode evaporates. Therefore, to eliminate the variations in coat formed by the electric discharge surface treatment, it is preferable that the electrode is stored in oil similar to the dielectric liquid. Flow of the dielectric fluid into the electrode is completed in several hours. However, if the electrode is stored in air thereafter, constituents prone to evaporation in the dielectric fluid evaporate, while those resistant to evaporation remains in the electrode. This affects binding strength of powder particles of the electrode material, and also affects a condition of the coat to be formed at the time of performing the electric discharge surface treatment with the electrode. Therefore, it is preferable that the electrode is stored in the dielectric solution.

That is, by storing the electrode in oil similar to the dielectric fluid, it is possible to eliminate in coat variations due to evaporation of the dielectric absorbed in the electrode in the electric discharge surface treatment.

However, because it takes several days to evaporate the dielectric fluid absorbed in the electrode, time for which the electrode is placed in air at each time of actual processing (for the electric discharge surface treatment) does not cause a problem. For example, when the electrode is set in a tool changer for automation, the electrode is not particularly required to be soaked in oil, as long as the electrode is set within a time in which the dielectric fluid absorbed in the electrode does not evaporate, and the electrode may be left in air.

According to the seventh embodiment, the electrode for electric discharge surface treatment is stored in oil, thereby preventing not only variations in the hardness of the electrode with time, but also oxidation of the electrode material. If the electrode includes an electrode material likely to be oxidized, when the electrode is stored in air for a long time, oxidation of the electrode material proceeds to affect a quality of the electrode and a quality of the coat to be formed. Therefore, by storing the electrode in oil, it is possible prevent the oxidation of the electrode material, and to stabilize the quality of the electrode and the quality of the coat formed by the electric discharge surface treatment using the electrode.

When the electrode for electric discharge surface treatment is stored in this manner, it is possible to effectively prevent deterioration in a quality of the electrode due to hardening or the like by storing the electrode in a package. The electrode may be packaged by vacuum packaging, soon after the electrode is manufactured.

In the seventh embodiment described above, the influence upon the formation of the coat of the dielectric absorbed in the electrode has been mentioned. As described above, soaking the electrode in the dielectric fluid is effective in preventing the oxidation of the electrode material.

As oxidation of the electrode material proceeds, the powder material of the electrode changes into ceramics, thereby making it difficult to form a dense coat. In addition to the method of soaking the electrode in the dielectric fluid, to prevent the oxidation of the electrode material, it is also effective to store the electrode in a vacuum package or in an inert gas (a noble gas), such as helium or argon, or an inert gas, such as nitrogen. However, in these cases, although the effect of preventing oxidation of the material can be achieved, the effect obtainable by the dielectric fluid sufficiently absorbed in the electrode cannot be achieved.

According to the eight embodiment, the electrode for electric discharge surface treatment is stored in vacuum or an inert gas, thereby preventing oxidation of the powder material of the electrode. As a result, even an electrode in which a long time has elapsed since manufactured can form a dense coat.

As described, according to the present invention, it is possible to manufacture an electrode for electric discharge surface treatment with which surface treatment in which a stable electric discharge is generated, and in which a thick coat can be formed without deteriorating surface roughness.

Moreover, according to the present invention, it is possible to manufacture an electrode with a metallic powder likely to be oxidized without making the metallic powder oxidized during a manufacturing process, and is possible to form a thick metallic coat by electric discharge surface treatment.

Furthermore, according to the present invention, it is possible to form a coat without variation by the electric discharge surface treatment by using the electrode for electric discharge surface treatment.

When the electrode for electric discharge surface treatment is stored in this manner, it is possible to effectively prevent deterioration in a quality of the electrode due to hardening or the like by storing the electrode in a package. The electrode may be packaged by vacuum packaging, soon after the electrode is manufactured.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electrode for electric discharge surface treatment, the electrode being a molded powder that is formed by molding a material powder that is any one of a metallic powder, a metallic compound powder, and a conductive ceramic powder, the electrode used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work, wherein a powder solid that has a diameter larger than a distance between the electrode and the work, is not included in the molded powder, the powder solid being formed as a result of coagulation of the material powder, wherein an average grain diameter of the material powder is 3 micrometers (μm) or less.

2. The electrode according to claim 1, wherein the diameter of the powder solid is 0.3 millimeters (mm) or less.

3. The electrode according to claim 1, wherein the metallic compound powder is a cobalt alloy powder.

4. The electrode according to claim 3, wherein the cobalt alloy powder is a stellite powder.

5. A method for manufacturing an electrode for electric discharge surface treatment, the electrode being a molded powder that is formed by molding a material powder that is any one of a metallic powder, a metallic compound powder, and a conductive ceramic powder, the electrode used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work, wherein a powder solid is sifted with a sifter having a mesh size less than a distance between the electrode and the work, the powder solid being formed as a result of coagulation of the material powder, whereby the powder solid included in the molded powder has a diameter shorter than the distance, and wherein, the electrode material includes a material hard to be carbonized for 40 volume % or more.

6. An electrode for electric discharge surface treatment, the electrode being a molded powder that is formed by molding a material power that is any one of a metallic powder and a metallic compound powder, the electrode used for electric discharge surface treatment in which a pulse-like electric discharge is caused between the electrode and a work in a dielectric fluid or an atmosphere, and in which a coat of an electrode material or a substance that is generated by a reaction of the electrode material due to an electric discharge energy is formed on a surface of the work, wherein the electrode is formed by molding the material powder that is finely crushed in wax, and an average grain diameter of the material powder is 3 micrometers (μm) or less.

7. An electrode for electric discharge surface treatment, the electrode being a molded powder that is formed by molding a material powder that includes a metallic powder, a metallic compound powder, and a ceramic powder, the electrode used for electric discharge surface treatment in which a pulse-like electric discharge is caused between the electrode and a work in a dielectric fluid, and in which a coat of an electrode material or a substance that is generated by a reaction of the electrode material due to an electric discharge energy is formed on a surface of the work, wherein any one of oil and the dielectric fluid is soaked in an internal space of the molded powder, and an average grain diameter of the material powder is 3 micrometers (μm) or less.

8. The electrode according to claim 7, wherein an average grain diameter of the metallic powder and the metallic compound powder is 3 mm or less.

9. The electrode according to claim 7, wherein the metallic powder and the metallic compound powder are any one of a cobalt powder and a cobalt-based alloy, the cobalt-based alloy including any one of chromium, nickel, and tungsten.

10. The electrode according to claim 7, wherein the electrode material includes a material less likely to be carbonized for 40 volume % or more.

11. An electrode for electric discharge surface treatment, the electrode being a molded powder that is formed by molding a material powder that includes a metallic powder, a metallic compound powder, and a ceramic powder, the electrode used for electric discharge surface treatment in which a pulse-like electric discharge is caused between the electrode and a work in a dielectric fluid, and in which a coat of an electrode material or a substance that is generated by a reaction of the electrode material due to an electric discharge energy is formed on a surface of the work, wherein the molded powder is heated, any one of oil and the dielectric fluid is soaked in an internal space of the molded powder heated, and an average grain diameter of the material powder is 3 micrometers (μm) or less.

12. The electrode according to claim 11, wherein an average grain diameter of the metallic powder and the metallic compound powder is 3 mm or less.

13. The electrode according to claim 11, wherein the metallic powder and the metallic compound powder are any one of a cobalt powder and a cobalt-based alloy, the cobalt-based alloy including any one of chromium, nickel, and tungsten.

14. The electrode according to claim 11, wherein the electrode material includes a material less likely to be carbonized for 40 volume % or more.

15. The electrode according to claim 1, wherein the electrode material includes a material hard to be carbonized for 40 volume % or more.

16. The electrode according to claim 1, wherein the electrode material includes Ni.

17. The electrode according to claim 1, wherein the powder solid is sifted with a sifter having a mesh size of approximately 0.3 mm.

18. The electrode according to claim 6, wherein the electrode is formed by molding the material powder that is finely crushed in wax using a vibration type ball mill and wherein the material powder comprises at least on of Cr powder and Mo powder.

* * * * *